US005349722A

United States Patent [19]

Chayer

[11] Patent Number: 5,349,722

[45] Date of Patent: Sep. 27, 1994

[54] METHODS OF AND APPARATUS FOR CONTAINING AND EVACUATING FLUIDS (II)

[76] Inventor: Steven Chayer, 4445 S. 168th St., Seatac, Wash. 98188

[21] Appl. No.: 940,651

[22] Filed: Sep. 4, 1992

Related U.S. Application Data

[63] Continuation-in-part of Ser. No. 725,635, Jul. 3, 1991, abandoned.

[51] Int. Cl.[5] ..... A47L 7/00

[52] U.S. Cl. ..... 15/353; 15/245; 15/393; 15/401; 15/418; 405/115

[58] Field of Search ..... 15/353, 393, 401, 418, 15/245; 405/115, 128; 137/142

[56] References Cited

U.S. PATENT DOCUMENTS

| | | | |
|---|---|---|---|
| 995,409 | 6/1911 | Lull | 15/393 |
| 2,240,005 | 4/1941 | Moyer | 15/393 X |
| 3,281,885 | 11/1966 | Hersh | 15/393 |
| 4,080,104 | 3/1978 | Brown | 15/353 X |
| 4,330,224 | 5/1982 | Muramatsu et al. | 405/115 |
| 4,720,889 | 1/1988 | Grave | 15/420 |
| 4,765,015 | 8/1988 | Torta | 15/401 X |
| 4,799,821 | 1/1989 | Brodersen | 405/115 |
| 4,839,061 | 6/1989 | Manchak et al. | 405/128 X |
| 4,961,246 | 10/1990 | Hauge et al. | 15/401 |
| 5,063,959 | 11/1991 | Peterson | 137/142 X |

FOREIGN PATENT DOCUMENTS

| | | | |
|---|---|---|---|
| 3143355 | 5/1983 | Fed. Rep. of Germany | 15/393 |

*Primary Examiner*—Chris K. Moore

*Attorney, Agent, or Firm*—Hughes, Multer & Schacht

[57] ABSTRACT

Systems for containing fluids and for both containing a fluid and then evacuating the contained fluid to a point of treatment or disposal. These systems have a fluid containment boom and a pump for creating a vacuum in the boom and compressing a portion of the lower side of the boom against a surface on which the boom is placed to lock the boom in place and form a barrier against fluid on the surface. The compressible portion may be made of a closed cell material in which case the contained fluid can be evacuated from the surface through the boom.

28 Claims, 15 Drawing Sheets

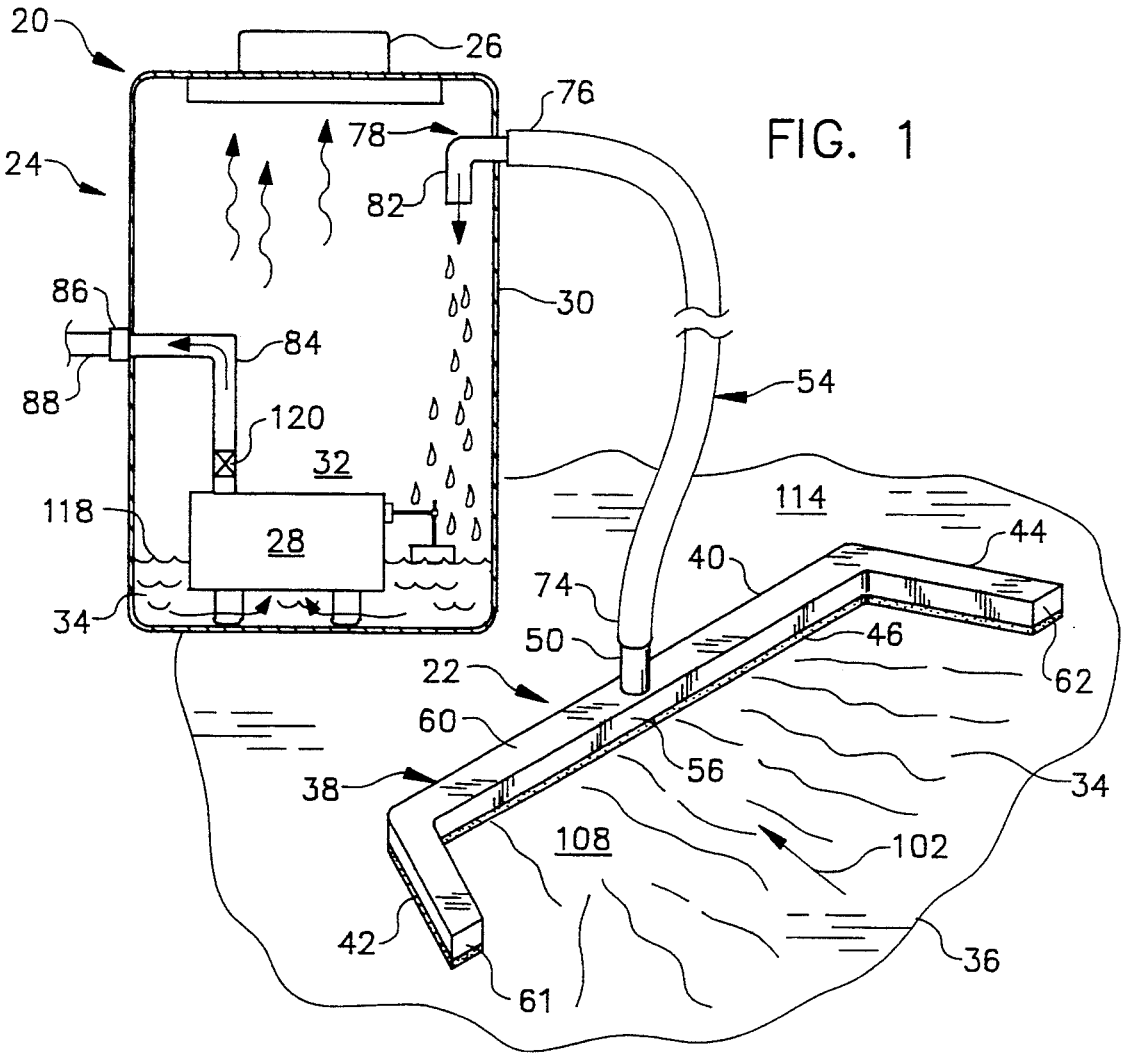
FIG. 1
FIG. 2
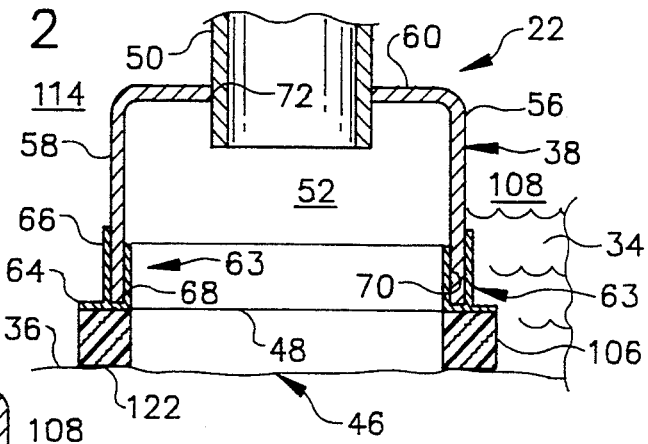
FIG. 3
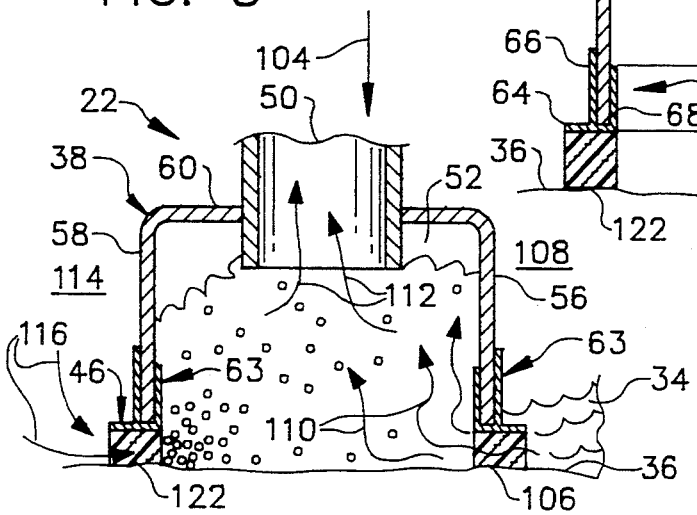

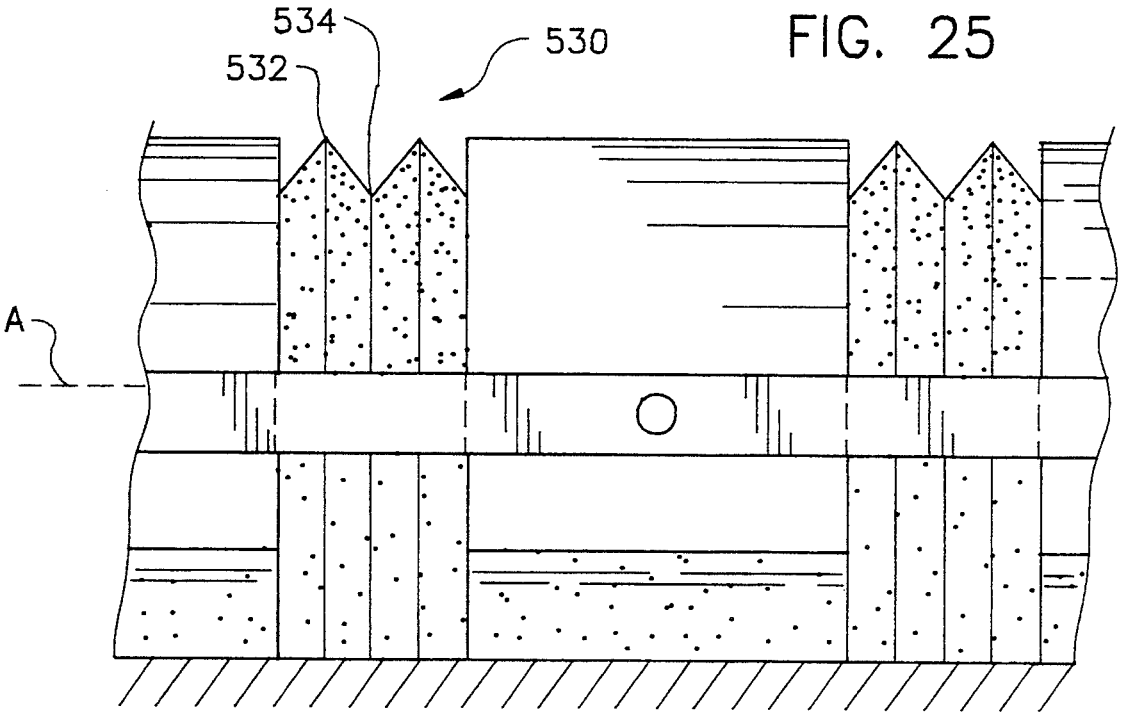
FIG. 25
FIG. 26
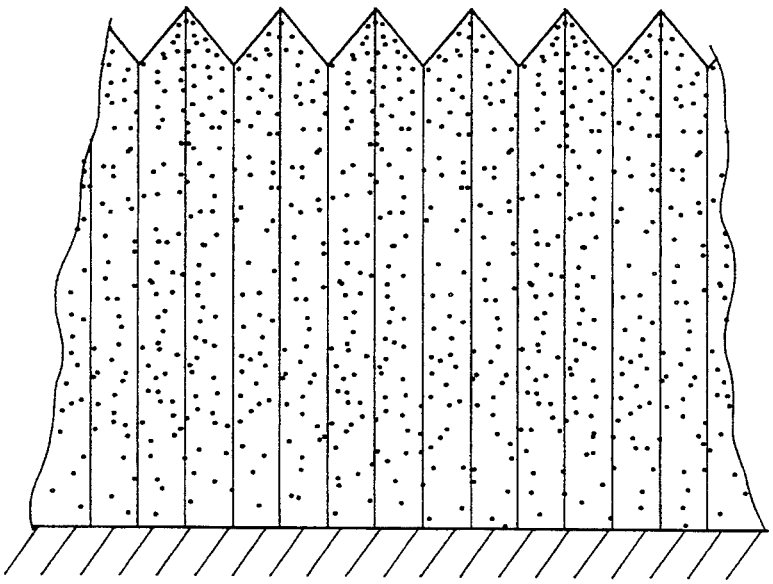

METHODS OF AND APPARATUS FOR CONTAINING AND EVACUATING FLUIDS (II)

RELATED APPLICATIONS

This is a continuation-in-part application of copending application Ser. No. 07/725,635, filed Jul. 3, 1991, now abandoned.

TECHNICAL FIELD OF THE INVENTION

The present invention relates to the containment and evacuation of fluids and, more particularly, to novel, improved methods of and apparatus for containing fluids present on surfaces and for removing fluids from those surfaces.

BACKGROUND OF THE INVENTION

Regulation of the quality of surface run-off water entering urban drainage systems is currently a high priority for many local, state and federal environmental agencies.

Surface run-off picks up chemicals, hydrocarbons, animal feces, and other pollutants. Such contaminated run-off has heretofore been allowed to flow unchecked into nearby storm drains. Contaminated water arises from: rain and snow, residential and commercial car washing, residential hose down, garage/shop concrete pad/floor washing, pressure washer cleaning, concrete sawing and drilling, aggregate washing, boatyard hull cleaning, parking lot surface cleaning and many other sources.

Also, drain cleaners often generate spilled water which may cause flood damage and pollution and require extensive clean up. Emergency response crews encounter flooding from broken pipes, sprinklers, failed valves, etc. Oftentimes, the flooding must be contained or diverted immediately to avert danger.

Sewage treatment plants have a limited processing capacity which, typically, is fully utilized if not over utilized. Therefore, as suggested above, strict controls on the generation of polluted surface water and other fluid contaminants which might reach sewers or storm drains are being widely implemented.

One approach to the resolution of this problem is to contain the polluting liquid and then remove it from the surface. Containment methods now used in emergency and non-emergency situations usually involve earthen berms, sandbags or absorbent materials. Constructing sand bag berms is a very time consuming and labor intensive process. Material to construct the berm has to be delivered to the emergency site. Bags are filled one at a time, and hundreds or thousands may be needed. Because time is of the essence in emergency situations, many people are required. Adsorbents have a limited storage capacity. Once used they must be disposed of. Also, none of the above methods prevents seepage completely.

Another method of resolving the problem is to block storm drain grates, thus preventing contaminated water from passing through them. The water is then allowed to stand until it either evaporates or is removed by a cleanup crew (usually with a vacuum truck).

Yet another method is to plug the drainage ports of catch basins and allow water to enter the basin. Later the contaminated water is pumped out and properly discharged.

In some situations waste water generators install expensive water reclamation systems. Unless the user is assured of being at that location over the long term, this approach may not be economical. This is because this method requires installation of a permanent, expensive wash pad and drain; this method is particularly disadvantageous when the user occupies a leased facility and must leave this investment in place when the facility is abandoned.

The above methods are very expensive and/or inconvenient. These difficulties force small quantity pollution generators to ignore discharge regulations. They'd rather risk getting caught and fined then go to the trouble and expense of pollution control.

Furthermore, as indicated above, complete containment of the polluting fluid is a serious problem. This is particularly true of fluid lying on a textured surface.

Examples of textured surfaces commonly polluted with fluid contaminants include: asphalt road pavements, parking lots, and driveways; washed aggregate; driveways; concrete pavements, sidewalks, waterways, vaults, culverts, parking garages, driveways, hard packed gravel staging pads, remote roads, parking lots, and industrial yards.

Containing liquids flowing on textured surfaces is difficult because of the large force required to compress a blocking material into the cracks and openings of the textured material to the extent necessary to prevent seeping. Even then, it is often difficult to produce a watertight seal; and any device relying on weight to generate a tight seal is too heavy and difficult to expeditiously handle.

The foregoing and other problems are resolved by the novel assemblies for containing and evacuating fluids disclosed in U.S. patent application No. 07/725,635, which is the parent application of the present application. In general, systems such as those disclosed in the parent application include a boom designed to act as a barrier to the offending fluid. This boom has a casing which defines a vacuum chamber and a compressible gasket at a lower open end of the casing. When the casing-defined chamber is evacuated, the pressure differential on the casing forces it toward the surface on which the boom is placed, compressing the gasket. This forces the gasket into intimate contact with the surface, locking the boom in place and producing a tight seal between the boom and the surface. This keeps the liquid from seeping or otherwise escaping past the boom.

The gasket may be fabricated from an impervious, compressible material in which case the boom serves simply as a barrier to migration of the offending liquid. Alternatively, a gasket with communicating open pores may be employed. Additionally, a fluid level-controlled pump may be provided to keep the reservoir from overflowing. Further, a variety of gasket materials, configurations, and mounting schemes can be employed.

One of the important advantages of fluid containment systems as described in the parent application No. 07/725,635 is that heavy weights are not required to generate a tight and effective seal between the boom and the surface on which it is employed. This is true even if the surface is a textured one as exemplified above or a textured surface of the character associated with ceramic and other tiles, decorative floor coverings, carpets, and the concrete floors of garages and basements.

However, in some cases the boom disclosed by the parent application No. 07/725,635 is insufficiently flexible to accommodate: (a) the surface on which the liquid to be contained is flowing or accumulating; and/or (b) the character of the accumulation or flow of this liquid.

For example, should the offending liquid be flowing or accumulating on a severely undulating surface, the boom may not be flexible enough to conform to such a surface; gaps through which liquid may escape may occur under the boom at points above low spots on the surface between two closely adjacent high spots thereon. Additionally, these gaps allow air to enter the plenum, reducing overall efficiency and performance of the system.

Additionally, if the offending liquid is flowing in a narrow stream, it may be desirable to place the boom on the surface in a U-shaped configuration so that the liquid flows into the open end of the "U." In this case, the boom should be capable of accommodating a tight radius at the bottom, closed end of the "U" and have long, straight, side walls for forming the sides of the "U".

Alternatively, if the offending liquid is accumulating in a pool, it may be desirable to form the boom in a circle that completely surrounds the pool.

Another potential problem with the device taught by the parent application No. 07/725,635 is the location and orientation of the fittings through which liquid is evacuated from the boom plenum. The Applicant has discovered that placing these fittings as disclosed in the parent application allows liquid to accumulate within the boom plenum. When the liquid level reaches the bottom end of the fitting, liquid is sucked into the line leading to the reservoir. This causes the vacuum system to "burp", interrupting the vacuum within the boom plenum and thereby allowing liquid trapped in the plenum to seep out from between the boom and the surface on which it sits. This arrangement of the fittings also inefficiently conveys air leaving the boom plenum into the vacuum hose.

A further difficulty is that the boom disclosed in the parent application is insufficiently flexible if it must be placed at odd angles to capture or gather liquids, to accommodate an obstacle in the boom's path, or to capture liquid flowing in all directions such as on a flat surface.

Finally, it would be desirable if the span of the boom could be increased or decreased as appropriate for a given situation. For example, a boom of a certain span might be too large to evacuate liquid from a first room and too small effectively to evacuate liquid from a second room.

SUMMARY OF THE INVENTION

It has now been found that principles of the present invention may be conveniently implemented with a boom assembly comprising at least one monolithic sponge-like sidewall and a plurality of separate ribs attached to this sidewall. The sponge-like sidewall defines a plenum into which the offending liquid is received and is compressible to form a seal at the juncture of the boom assembly and the surface on which it rests. The ribs provide structural integrity to the sponge-like sidewall; however, these ribs are not rigidly attached to each other.

By providing a plurality of ribs which are not rigidly attached to each other, the options available for configuring the boom assembly are significantly increased. The boom assembly using a sponge-like sidewall and a plurality of separate ribs as briefly described above can: (a) accommodate a severely undulated surface; and (b) be curved into an arc or circle with a small radius of curvature. These factors greatly increase the flexibility of boom for use under diverse conditions.

A number of methods are available for attaching ribs to the sponge-like sidewall. One exemplary method is to employ an adhesive to chemically bond these two components together. A second method is to provide an inner rib corresponding to the outer rib and clamping the sidewall between the inner and outer ribs. In certain situations, it may further be desirable to adhere a layer to the sidewall to which the ribs are attached. This layer should provide additional structural integrity to the sponge-like sidewall but still allow the bending and compression desired of this sidewall. Additionally, to prevent the sidewall from being overstretched and thus its structural integrity compromised, flexible but non-stretchable straps may be attached between adjacent ribs.

An additional discovery is that the difficulties of evacuating liquid presented by the fittings disclosed in the parent application No. 07/725,635 can be alleviated by so placing the fitting that its opening is angled with respect to the level of the liquid within the boom plenum. As will be discussed in more detail below, this ensures that the air entering the fitting opening atomizes the liquid before the liquid is drawn into the reservoir, thereby preventing the "burping" effect described above.

Also, it has been found that the span of a boom may be adjusted by any one of several methods. In the articulated architecture described above employing separate ribs, the boom may be divided into sections having two end ribs. The end ribs may be provided with flanges to allow such sections to be joined together as necessary to obtain a boom with the desired overall span. Alternatively, the ribs can be made to telescope within one another, providing additional boom span merely by pulling out successive ribs until the desired span is obtained.

OBJECTS OF THE INVENTION

From the foregoing, it will be apparent to the reader that one important and primary object of the present invention resides in the provision of novel, improved fluid containment and fluid containment/fluid evacuation systems and in the provision of equally novel fluid containment booms for such systems.

Other also important but more specific objects of the invention reside in the provision of fluid containment systems:

- which are highly effective, even in circumstances in which heretofore proposed and available fluid containment systems are not;
- which can be employed in a wide variety of applications;
- which are easy to employ, operate, store, and transport from one location to another;
- which are versatile in that the same system can be employed in applications in which the volume of fluid to be contained varies widely;
- which can be supplied in configurations in which the system is capable of both containing fluid and of evacuating the fluid;
- which are sufficiently flexible to allow the boom to conform to a severely undulated surface; and
- which are additionally sufficiently flexible to allow the boom to curve into different configurations as necessary for a particular liquid flow and accumulation.

Other important objects, features, and advantages of the present invention will be apparent to the reader from the foregoing and the appended claims and as the ensuing detailed description and discussion proceeds in conjunction with the accompanying drawing.

BRIEF DESCRIPTION OF THE DRAWING

In the drawing:

FIG. 1 is a generally pictorial view of a system which employs the principles of the present invention and is designed to contain a fluid present on a surface and to evacuate the fluid from that surface;

FIG. 2 is a section, taken substantially along line 1—1 of FIG. 1, through a containment boom employed in the system of FIG. 1 to contain the fluid;

FIG. 3 is a view, similar to FIG. 2, of the containment boom with a vacuum applied to it by a vacuum unit also incorporated in the system of FIG. 1; this immobilizes the containment boom on the surface on which the fluid is present and effects the evacuation of fluid from the surface through the boom;

FIG. 25 is a side, plan view of a portion of yet another boom which employs the principles of the present invention and may be used in the system shown in FIG. 1;

FIG. 26 is a side, plan view of a portion of still another boom which employs the principles of the present invention and may be used in the system shown in FIG. 1;

DETAILED DESCRIPTION OF THE INVENTION

Figure 4:
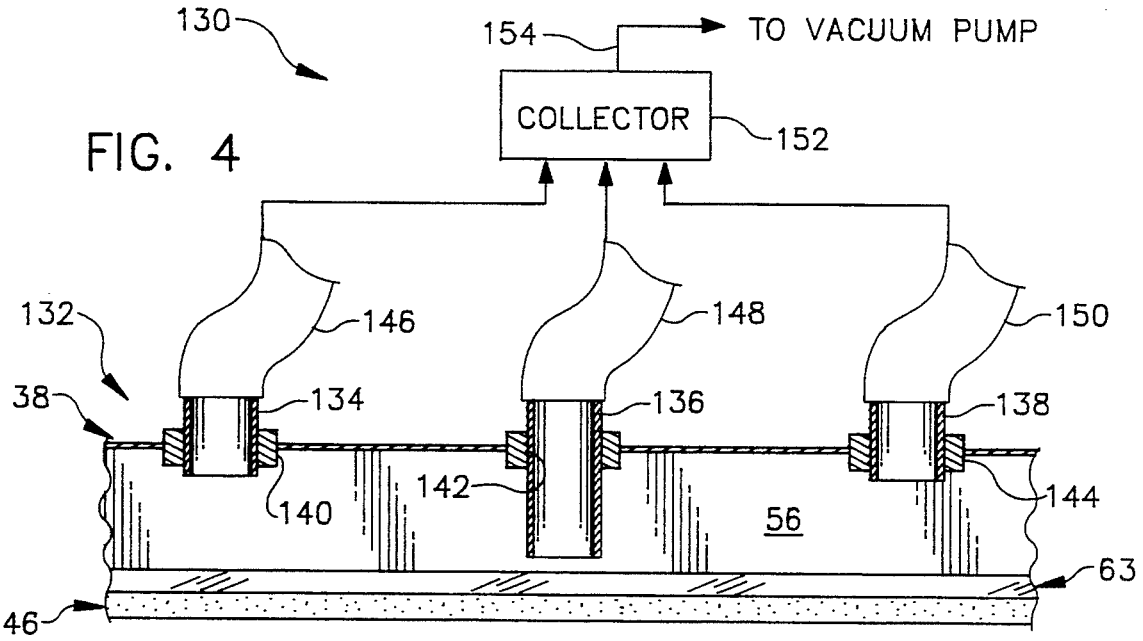
FIG. 4 is a section through a second containment boom employing the principles of the present invention; it differs from the boom depicted in FIGS. 1–3 in that it has multiple ports for evacuating the interior of the boom.

Referring now to the drawing, FIG. 1 depicts a fluid containment and evacuation system 20 constructed in accord with, and embodying, the principles of the present invention. The major components of system 20 are a fluid containment boom 22 and a unit 24 which includes a vacuum pump 26 and a second pump 28. These two pumps are respectively supported from and housed in a casing 30. This casing provides a reservoir 32 for fluid 34: lying on a surface 36, prevented from flowing along that surface by containment boom 22, and evacuated from the surface through the boom.

Referring now to FIGS. 2 and 3 as well as FIG. 1, fluid containment boom 22 is also constructed in accord with the principles of the present invention. It includes an elongated casing 38 with a rectilinear center section 40 and integral wings 42 and 44 at, and forming obtuse angles with, center section 40 at the opposite ends thereof. The boom also has a compressible gasket 46 which extends around the periphery of casing 38 at the open bottom or lower edge 48 thereof and a fitting 50. That fitting provides fluid communication between an internal vacuum plenum 52 defined by casing 38 and a flexible vacuum line or hose 54. Hose 54 extends between, and connects, boom 22 and the associated vacuum unit 24.

Casing 38 may be fabricated from any appropriate, structurally stable, metallic or non-metallic material. It has depending front and rear (or wet and dry side) walls 56 and 58, a top wall 60, and ends walls 61 and 62. The casing is open at its bottom edge 48 as was stated above.

The illustrated, exemplary gasket 46 at the lower edge 48 of casing 38 is of monolithic construction, has a rectangular cross-sectional configuration, and is fabricated from a resiliently compressible polymer with a relative high proportion of open, interconnected pores. This open pore structure provides paths via which liquid 34 trapped by containment boom 22 can be drawn from surface 36 into the internal chamber or plenum 52 defined by the top, front, rear, and end walls of casing 38 and by gasket 46.

One exemplary material from which gasket 46 can be fabricated is Vertifoam Grade TA55190-815. This material is supplied by Grain Pacific and has the following properties:

| | |
|---|---|
| Density, Lbs./Cu. Ft. | 1.8–2.2 |
| ILD. Lbs./50 sq. in. 25% (4" | 50–60 |
| Tensile Strength, psi | 15–25 |
| Elongation, % | 200–300 |
| Resilience, % | 25–30 |
| Compression Sets, 90%, 22 hrs, 158° F. | 10% Maximum |
| Die Cutability | Good |
| Color | Charcoal |
| K Factor @ 30° F. | 0.24–0.29 |
| Operating Temperature | −40° F.–+300° F. |
| N.R.C. @ 1" | 0.52 |
| Solvent Resistance | Swollen slightly by hydrocarbons. Regains original physical properties after solvent evaporation. |
| Hydrolytic Stability | Applications involving hydrolytic stability should be investigated in the case of polyester. |

In that exemplary embodiment of the invention illustrated in FIG. 2, gasket 46 is attached as with an appropriate adhesive (not shown) to a support or clip 63 with a configuration complementing that of casing 38. Clip 63 has a platform 64 and vertically extending legs 66 and 68 . These legs form a recess 70 for the side and end walls 56, 58, 61, and 62 of containment boom casing 38. With casing 38 and clip 63 assembled together as shown in FIGS. 2 and 3, the friction between the opposed sides of the clip's vertical legs 66 and 68 and the walls of the casing hold these two components together yet allow the clipgasket unit to be readily detached.

Referring still to FIGS. 1–3, vacuum fitting 50 may be a short section of tubing. It extends through a complementary aperture 72 in the top wall 60 of containment boom casing 38 and is secured in place as by welding or in any other convenient fashion.

Referring now most particularly to FIG. 1, vacuum line 54 is connected at boom end 74 to fitting 50, thereby communicating with the plenum 52 in containment boom casing 38. The opposite end 76 of hose 54 is attached to an elbow 78 which extends through the casing 30 of vacuum unit 24, providing fluid communication between vacuum line 54 and the reservoir/vacuum chamber 32 in the casing. A downwardly extending leg 82 of the elbow directs fluid evacuated from surface 36 through vacuum hose 54 toward the bottom of the reservoir 32 in vacuum unit casing 30.

As discussed above, the casing 30 of unit 24 houses a vacuum pump 26 and a second pump 28. Both pumps are of conventional configuration, and vacuum pump 26 is mounted in the upper reaches of casing 30 in a conventional manner. Second pump 28 is mounted at the bottom of casing 30. The second pump 28 communicates, on its inlet side, with reservoir 32. The discharge side of second pump 28 is connected through an internal line 84 to an externally accessible fitting 86. An external line or hose 88 leads from fitting 86 to a convenient point-of-disposal or treatment facility (not shown).

Figure 14:
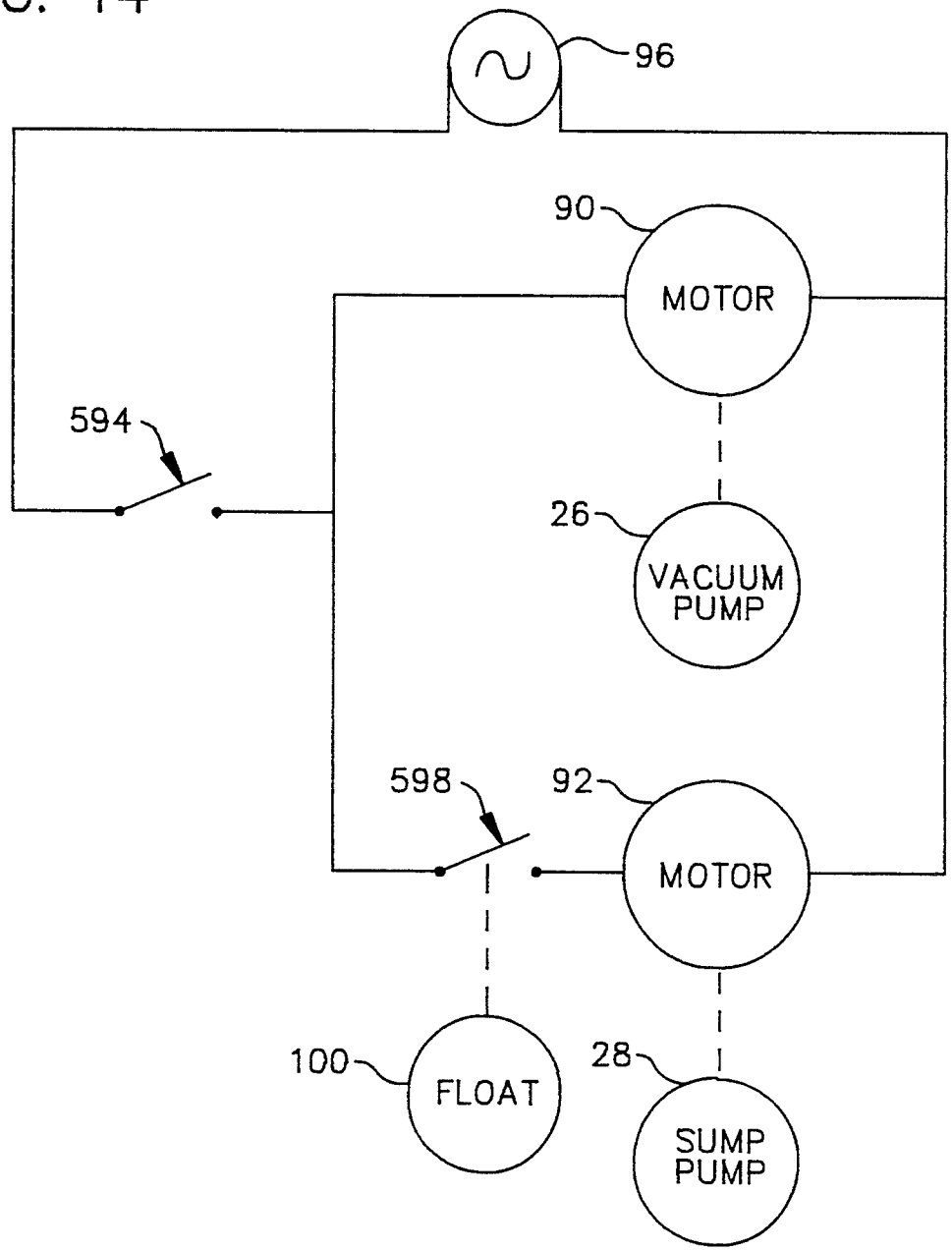
FIG. 14 is a schematic of a control system for fluid containment and evacuation systems of the character illustrated in FIGS. 1 and 13.

Turning now to FIG. 14, vacuum pump 26 and second pump 28 are driven by electric motors 90 and 92. These motors are connected in parallel through a manual switch S94 to an electrical power source 96. A second switch S98, actuated by a float 100 in conventional fashion, is connected in series with switch S94 and between it and the motor 92 of second pump 28.

Referring now to FIGS. 1–3 and 14, the operation of fluid containment and evacuation system 20 is typically initiated by placing fluid containment boom 22 on a surface 36 in the path of the liquid 34 on that surface and flowing in the direction indicated by arrow 102 so that the liquid cannot move beyond the location where boom 22 is placed. Next, manual switch S94 is closed by the operator, turning on vacuum pump 26. This results in the air in the vacuum plenum 52 defined by boom casing 38 being evacuated through vacuum line 54. As this occurs, a differential between atmospheric pressure on the exterior side of casing 38 and the pressure in the plenum is created. The pressure differential results in the boom casing being displaced downwardly as suggested by arrow 104 in FIG. 3. As this continues, the gasket 46 at the bottom of the boom casing 38 is compressed. Because the material from which the gasket is fabricated is resiliently compressible, the gasket faithfully follows the contour of surface 36 and irregularities in that surface. It therefore generates a tight seal between the boom and the surface on which the boom is placed. This results in the boom being firmly and positively held in the wanted position on surface 36 without the need of weighing down the boom, employing mechanical fasteners, or taking other similarly undesirable steps to hold it in place.

Also, as the vacuum is drawn in plenum 52, the above-alluded-to pressure differential effects a flow of fluid 34 through the segment 106 of gasket 46 on the wet side 108 of boom 22 into the vacuum plenum 52 as is shown by arrows 110. Once fluid 34 reaches plenum 52, it is atomized and evacuated from the boom through fitting 50 and vacuum line 54 as indicated by arrows 112. Line 54 discharges the evacuated liquid into the reservoir 32 of vacuum unit 24 through elbow 78 (see FIG. 1). Further, the pressure differential prevents any fluid within the boom plenum 52 from leaking outside of the boom 22 through any orifice other than that leading to the vacuum hose 54.

As is apparent from FIGS. 2 and 3, the casing 38 of containment boom 22 serves as a barrier and keeps fluid on surface 36 from migrating past the boom. Because of the tight seal between gasket 46 and that surface, liquid 34 cannot seep under the boom, a phenomenon that is common in other fluid containment systems such as those employing sandbags, for example. Furthermore, liquid 34 drawn into vacuum plenum 52 cannot leak through the gasket 46 on the dry side 114 of boom 22. The air flowing into the vacuum plenum through gasket 46 on that side of the boom as shown by arrows 116 blocks outmigration of liquid 34 through the gasket. This incoming air also effects the above-discussed atomization of the liquid entering vacuum plenum 52 through that segment 106 of seal 46 on the wet side 108 of the boom.

As fluid 34 is evacuated from surface 36 in the manner just described, the level 118 of the fluid discharged into vacuum unit 24 rises and the weight of the unit increases. Second pump 28 is optionally employed to keep unit 24 from overflowing and to keep the weight of unit 24 down so that it can be easily handled. This is done by limiting the amount of fluid in reservoir 32.

More particularly, as float 100 reaches the indicated level 118, it closes float-actuated switch S98, completing a circuit between the motor 92 of second pump 28 and power source 96, turning on the pump. Thereupon, second pump 28 discharges liquid 34 from vacuum unit reservoir 32 through internal line 84, external connection 86, and line or hose 88 to the selected point-of-disposal or treatment facility. A conventional check value 120 keeps the fluid from flowing back into second pump 28. This valve also keeps air from entering casing 30 through lines 84 and 86 when the pump is not operating.

As the level 118 of the fluid in reservoir 32 drops, float 100 moves downwardly, allowing switch S98 to open. To insure that the pump operates for a long enough period of time to pump out reservoir 32, a conventional delay circuit (not shown) may be installed between float-operated switch S98 and sump motor 92 so that the motor will continue to run for a specified period of time after switch S98 opens.

Once the need for fluid containment or containment and evacuation is satisfied, the manually operable switch S94 of system 20 is opened, turning off vacuum pump 26. Thereupon, air entering the vacuum plenum 52 in boom 22 through the dry side segment 122 of gasket 46 (and possibly also through wet side gasket segment 106) equalizes the internal and external pressures on boom casing 38. This breaks the seal between gasket 46 and the surface 36 on which the boom is located. Boom 22 can then easily be lifted from surface 36 and moved.

As will be apparent to the reader from the brief description of the drawing, FIGS. 4–13 of the drawing depict embodiments of the invention different from that just discussed. To the extent that the elements of the systems and system components in the several embodiments are alike, they will be identified in this specification by the same reference characters.

Returning then to the drawing, FIG. 4 depicts a system 130 differing from the above-discussed fluid containment and evacuation system 20 primarily in the manner in which the fluid containment boom 132 of system 130 is connected to the system's vacuum unit (this unit is not shown but may be identical to the vacuum unit 24 depicted in FIG. 1).

The construction depicted in FIG. 4 is intended for booms which are relatively long. A number of vacuum connections or fittings are employed to insure that an acceptable level of vacuum is maintained over the span of the boom. Thus, in the exemplary boom 132 shown in FIG. 4, three such fittings 134, 136, and 138 are supplied. The three fittings extend through apertures 140, 142, and 144 in the top wall 60 of boom casing 38 and provide fluid communication between the plenum 52 in that casing and fitting-associated vacuum lines 146, 148, and 150. The vacuum lines 146 . . . 150 lead to a conventional collector 152. A collector outlet line or hose 154 provides fluid communication between the collector and the vacuum unit of system 130.

Figure 5:
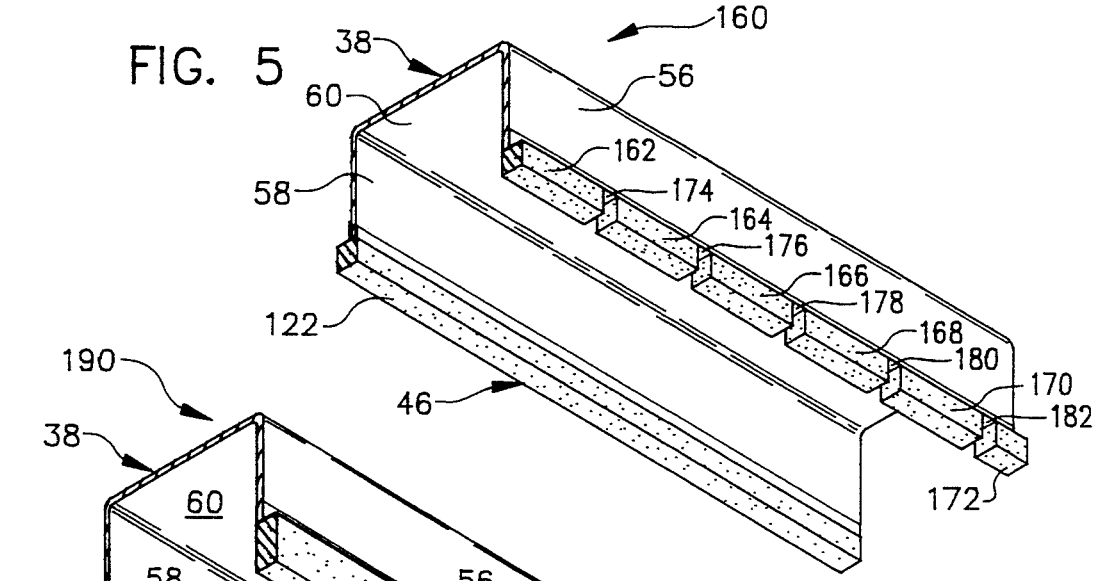
FIGS. 5 and 6 are isometric views of two other containment booms utilizing the principles of the present invention; these differ from the boom illustrated in FIGS. 1–3 in the configuration of a compressible gasket provided in the boom to seal it to, and immobilize it in, a particular location on a surface.

FIG. 5 depicts a boom 160 in which the continuous wet side segment 106 of gasket 46 is replaced with a series of segments 162 . . . 172 separated by narrow gaps 174 . . . 182. A boom of this construction may be preferable in applications where the evacuation of large quantities of fluid from a surface is anticipated. In boom 160, fluid can flow into the vacuum plenum 52 of the boom through the gaps 174 . . . 182 between gasket segments 162 . . . 172 as well as through the communicating, open pores in the segments.

Figure 6:
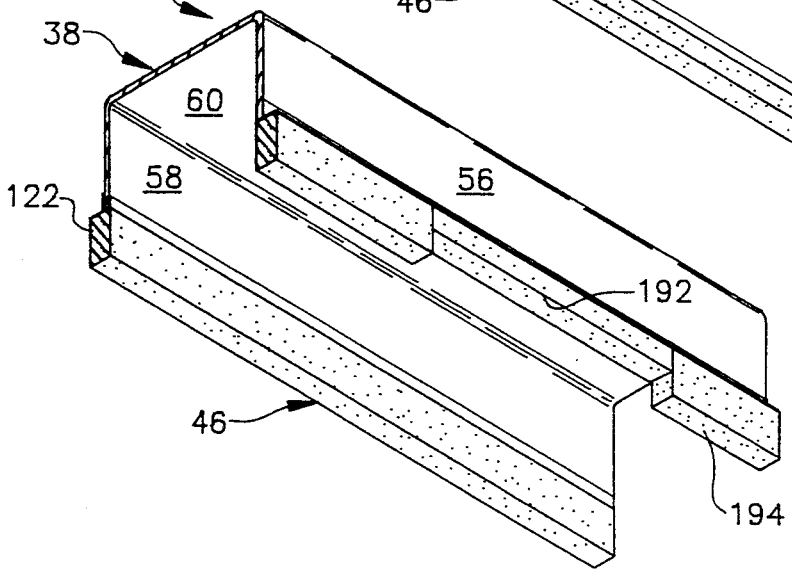

Another boom designed for the evacuation of relatively large quantities of fluid from a surface is illustrated in FIG. 6 and identified by reference character 190. In this boom, a gasket 46 with a continuous wet side segment 106 is employed, but an elongated recess or notch 192 opening onto the lower edge 194 of gasket segment 106 is provided. In the operation of a system in which boom 190 is employed, fluid can migrate from a surface to the vacuum chamber 52 in this boom through notch or gap 192 as well as through the pores in the gasket segment 106. This notch or gap 192 allows fluid to continue to enter the vacuum plenum after solids have plugged the communicating pores in the gasket 46.

There are applications of the invention in which only containment and not evacuation of a fluid 34 from a surface 36 is required or wanted. In this case, the gasket can be fabricated from a material which is resiliently compressible and therefore capable of providing a tight seal but is of closed cell or other impervious construction. A vacuum unit without a pump is employed. Otherwise, the booms and the systems in which they are employed may be like those discussed above.

Figure 7:
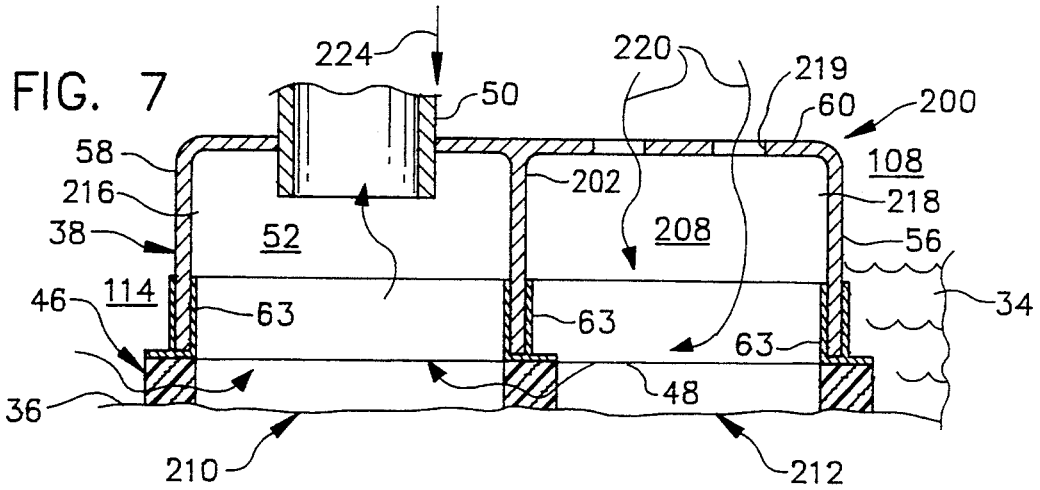
FIG. 7 is a traverse section through a boom which employs the principles of the present invention and is designed to function only as a barrier against fluid present on a surface on which the boom is placed.

Alternatively, a boom of the character depicted in FIG. 7 and identified by reference character 200 may be employed in those circumstances in which only containment and not containment plus evacuation is wanted.

Containment boom 200 differs from the booms discussed above in that it has an integral partition 202 which extends downwardly from the top wall 60 of the boom casing at a location between the front and rear or wet and dry side walls 56 and 58 of the casing. Partition 202 terminates at the bottom or lower edge 48 of casing 38. It divides the interior of casing 38 into vacuum chamber 52 and an adjoining chamber 208.

Boom 200 also differs from those discussed above in that it has two, separate, dry and wet side gaskets 210 and 212 at the bottom 48 of boom casing 38.

Dry side gasket 210 surrounds vacuum plenum 52, extending along boom casing rear wall 58, partition 202, and those segments of the casing end walls between rear wall 58 and partition 202. One of these end wall segments is identified in FIG. 7 by reference character 216.

The associated and cooperating wet side gasket 212 surrounds the adjoining chamber 208 and is likewise located at the bottom 48 of boom casing 38. The segments of this gasket extend along partition 202 and wet side casing wall 56 and along those segments of the casing end wall between the partition and side wall 56. One of these end wall segments is identified in FIG. 7 by reference character 218. Apertures 219 in the upper wall 60 of casing 38 allow air to flow into chamber 208 as indicated by arrows 220. Therefore, the pressure on that side of partition 202 opposite vacuum chamber 52 is atmospheric. Thus, when negative pressure is created in vacuum plenum 52, a uniform delta pressure is exerted toward the front (partition 102) side and the rear (wall 58) side of casing top wall 60. As in the booms discussed above, this clamps and seals the boom against the surface 36 on which it is positioned by virtue of the pressure differential on the outer and inner sides of casing top wall moving the boom downwardly to compress dry side seal 210 as is suggested by arrow 224. The downward movement of the boom casing also compresses impermeable wet side seal 212, tightly sealing that gasket to the surface 36 on which the boom is positioned. This seal and wet side casing wall 56 consequently provide an effective, fluidtight barrier against the liquid 34 on surface 36.

The thus far described fluid containment booms have gaskets of a one-piece monolithic nature and a gasket support or mount which slips over the lower edge of the boom's casing. Other representative gaskets and gasket supports, intended to optimize the boom for particular applications, are depicted in FIGS. 8–10.

Figure 8:
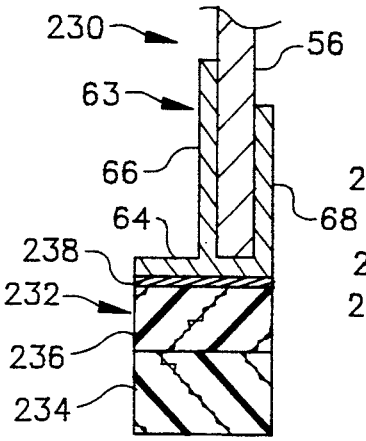
FIGS. 8–10 are fragmentary cross-sections through containment booms like that depicted in FIGS. 1–3 but with a different type of compressible gasket (FIGS. 8 and 10) or a different type of mechanism for securing the gasket to the casing of the boom (FIGS. 9 & 10)

Thus, FIG. 8 depicts a boom 230 with a bipartite gasket 232 having a bottom layer 234 and a top layer 236. Gasket 232 is cemented to the horizontal platform 64 of the gasket support 63 by adhesive identified with reference character 238.

In a gasket like that identified by reference character 232, different functions can be assigned to the different gasket elements to optimize the performance of the gasket. For example, the lower element 234 may be selected for its ability to deform against the surface on which the boom is placed and optimize the seal between the boom and supporting surface with minimal attention being paid to the permeability of that element. At the same time, the upper gasket element 236 may be selected to optimize the migration of fluid through the gasket into the vacuum chamber of the boom.

Figure 9:
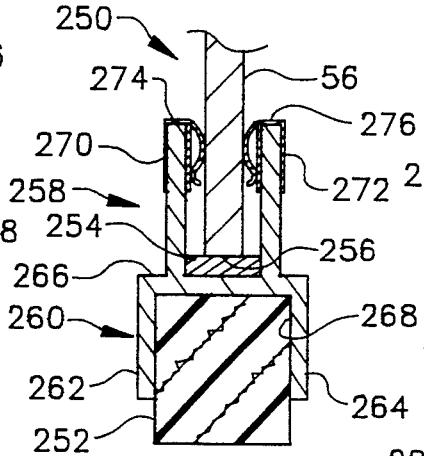
Figure 10:
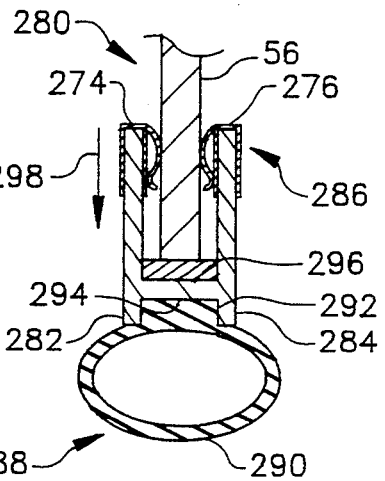

Referring still to the drawings, FIG. 9 depicts a boom 250 which employs a gasket 252 like that identified with reference character 46 but a different type of system for attaching the gasket to boom casing 38. In particular, the gasket supporting and mounting arrangement depicted in FIG. 9 includes one or more transversely and horizontally oriented plates or shims 252 fixed to the boom casing walls at the bottom 48 of the casing. One such shim, identified by reference character 254 in FIG. 9, is so attached to the lower edge 256 of the front casing wall 56 on the wet side 108 of the boom.

A second component 258 of the gasket supporting system (shown in FIG. 9) is detachable from the boom casing 38 with which it is employed. This component has a generally U-shaped element 260 with depending, spaced apart segments 262 and 264 and a horizontal upper segment 266. The three segments 262 . . . 266 define a recess 268 with an open lower end in which gasket 252 is installed.

Gasket support component 258 also has two, parallel, upper legs 270 and 272 which are integral with, and extend vertically from, horizontal support segment 266. The spacing between legs 270 and 272 equals the width of the strap or shim 254 on the bottom edge of the casing walls.

Also, the FIG. 9 gasket mounting arrangement includes spring clips 274 and 276. These are installed on the upper ends of support component vertical legs 270 and 272.

With gasket-supporting component 258 assembled to a front, rear, or end wall of casing 38, shim 254 is seated against support component segment 266. Its edges engage vertical segments or legs 272 and 274, positioning component 258 and the gasket 252 it carries relative to the casing. Spring clips 274 and 276 engage opposite sides of the casing wall. This further orients support component 258 relative to the casing wall and insures that there is sufficient frictional force between the component and associated casing wall to hold the component 258 securely in place.

The boom 280 depicted in FIG. 10 employs a mounting system like that just discussed except that the lower, vertical segments 282 and 284 of detachable gasket-supporting component 286 are somewhat shorter than the corresponding segments 262 and 264 of detachable gasket mount 258. However, a substantially different type of gasket, identified by reference character 288, is employed.

This gasket has a seal segment 290 with an oval or elliptical cross section and an integral attachment segment 292. Segment 292 has a cross section complementing that of the recess 294 defined in support 286 by support segments 282 and 284 and a third, horizontally oriented and integral segment 296. With gasket 288 assembled to its support 286, the upper, integral segment 292 is seated in recess 294. It is retained in place by friction or by an appropriate adhesive if necessary.

A fluid containment or fluid containment and evacuating system employing boom 280 is operated in the same manner as those discussed previously. A vacuum is created in the plenum 52 of the boom's casing 38 to draw the boom downwardly as indicated by arrow 298. The elliptical, sealing segment 290 of gasket 288 is thereby forced downwardly into intimate contact with the surface on which boom 280 is employed, providing a tight seal between that surface and the boom. Depending upon whether the gasket is fabricated from an impervious or permeable material, it will either: (a) act solely as a barrier to liquid on the surface, or (b) act as a barrier but allow liquid to pass to vacuum plenum 52.

Figure 11:
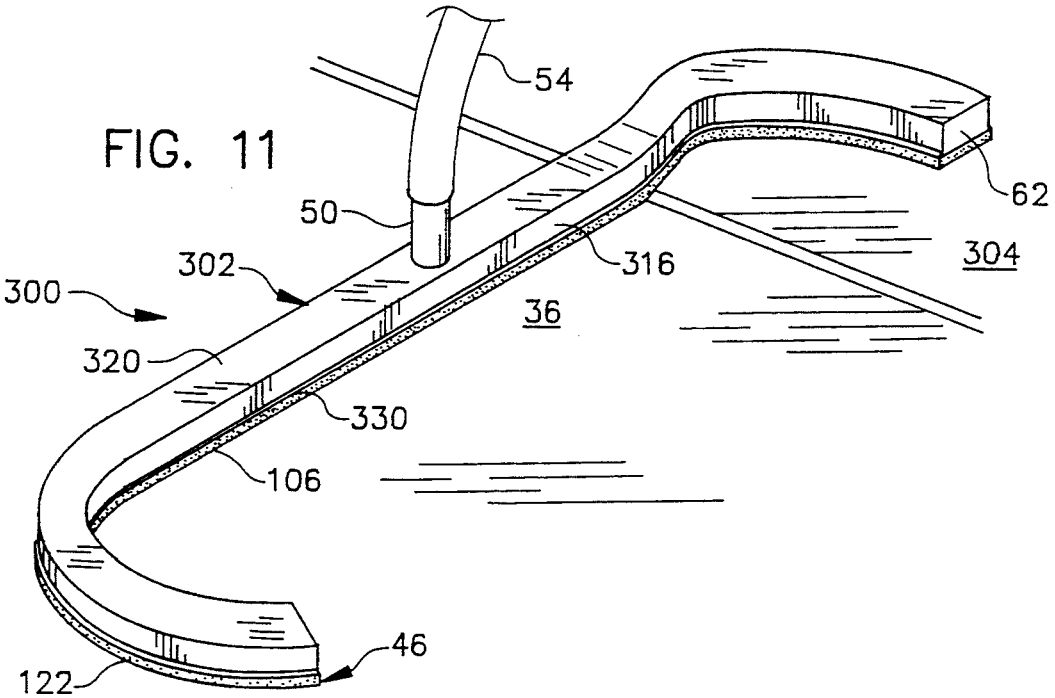
FIG. 11 is a pictorial view of a fluid containment boom of the same character as the boom shown in FIGS. 1–3 but fabricated in a manner which allows the configuration of the boom to be altered on site to meet the needs of particular circumstances.

Those booms employing the principles of the present invention which have thus far been described have casings 38 fabricated of a rigid or semirigid material. Booms employing the principles of the present invention can instead be provided with casings made from materials that allow the boom to be bent or otherwise distorted into configurations which are optimal for the application at hand. One such boom is illustrated in FIGS. 11 and 12 and identified by reference character 300.

The casing 302 of this boom is fabricated from a material which can be bent, twisted, or otherwise shaped such as natural or synthetic rubber rather than a rigid or semirigid material. As a result, the configuration of the boom can readily be optimized for a particular application. A representative configuration is shown in FIG. 11. Also, as shown in the same figure, boom 300 can be distorted in other ways to accommodate the needs of a particular situation—in this case, to insure that the gasket 46 of the boom is tightly sealed to two different surfaces 36 and 304 at slightly different elevations.

Figure 12:
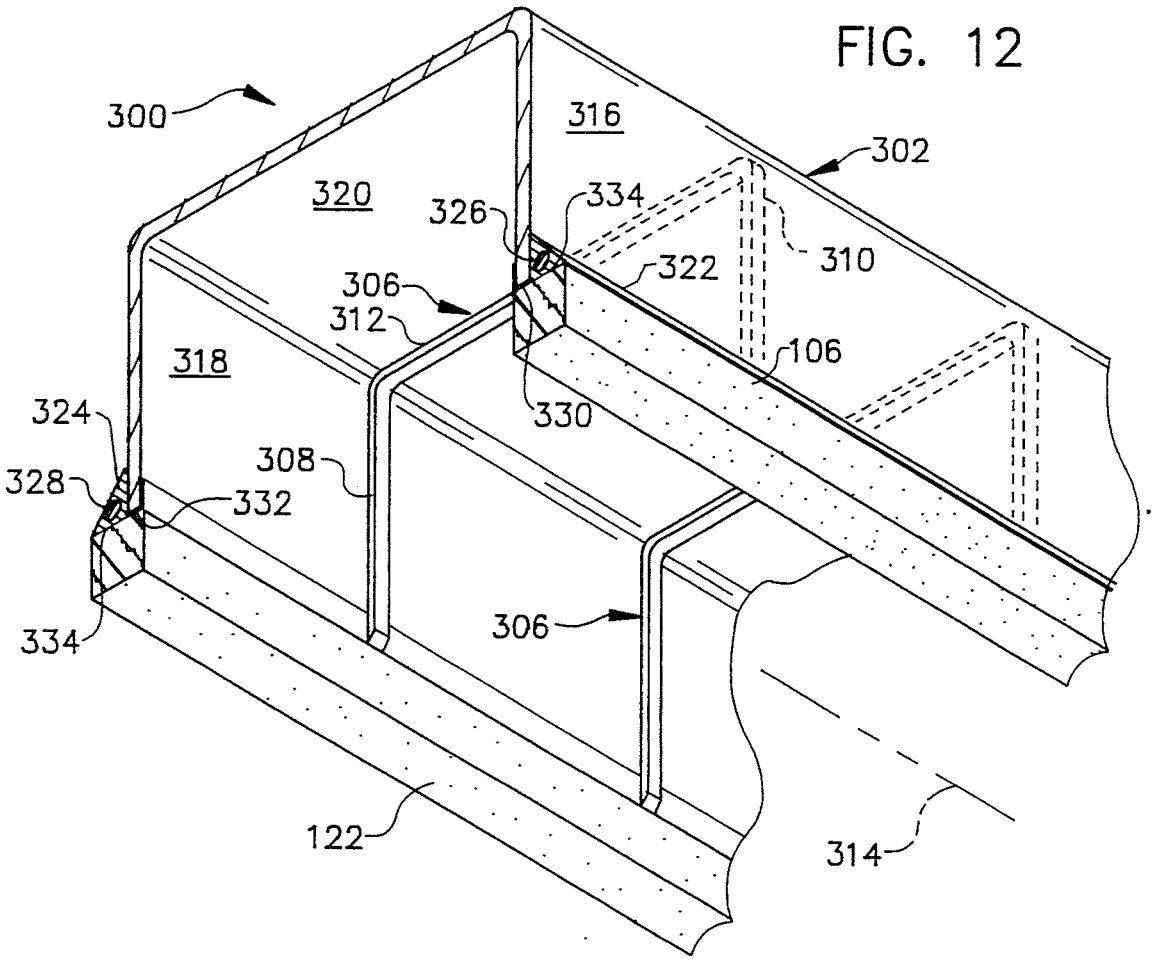
FIG. 12 is fragment of the boom shown in FIG. 11 drawn to an enlarged scale to detail the construction of the boom.

As is shown in FIG. 12, reinforcing ribs 306 are preferably employed to structurally stabilize boom casing 302. Ribs 306 each have a U-shaped configuration defined by vertical segments 308 and 310 and a horizontal segment 312. Ribs 306 are oriented normal to the longitudinal axis 314 of boom 300. The rib segments extend along and span side walls 316 and 318 of the boom casing 302 and its top wall 320 on the inner side of the casing. The reinforcing ribs are secured in place with an appropriate adhesive or in any other desired fashion.

For additional structural stability, the elongated, triangularly sectioned, flexible reinforcing members 322 and 324 with integral, embedded, wirelike elements 326 and 328 shown in FIG. 12 are preferably employed. Reinforcing members 322 and 324 extend along casing side walls 316 and 318 at the lower edges 330 and 332 of those walls and are fastened to the inner sides of the walls. Again, an appropriate adhesive may be employed.

As is shown in FIG. 12, the reinforcing components 322 and 324 are also employed in supporting gasket 46 from the casing 302 of boom 300. Gasket 46 spans the lower edge of each associated casing wall and the lower, horizontally oriented, flat surface 334 of the associated reinforcing component. The gasket is adhesively bonded or otherwise secured in place.

Furthermore, the embedded elements 322 and 324 ensure that the boom will remain in the configuration to which it is shaped. Reinforcing elements formed from soft steel wire satisfactorily perform this function.

Figure 13:
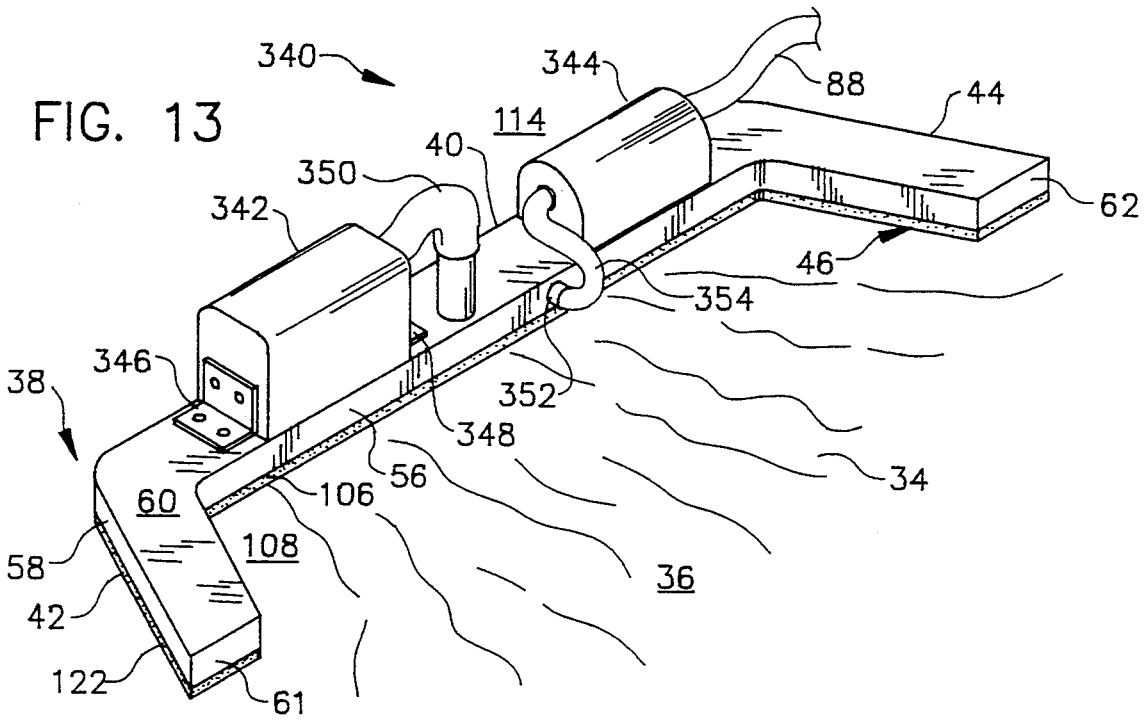
FIG. 13 is a pictorial view of a fluid containment system of the character shown in FIG. 1 but with a vacuum pump and a pump employed in the system mounted on the fluid containment boom of the system.

It will be remembered that the fluid containment and evacuation system 20 illustrated in FIG. 1 includes a fluid containment boom and a vacuum unit connected by a hose or line 54. FIG. 13 depicts a different, but comparably advantageous, fluid containment and evacuation system 340 in which the functions of the independent vacuum unit 24 of system 20 are instead performed by a vacuum pump 342 and a fluid evacuation pump 344 mounted on the top wall 60 of boom casing 38 as by the illustrated brackets 346 and 348. Vacuum pump 342 is connected to the vacuum plenum in casing 38 by fitting 50 and vacuum hose 350. A fitting 352 in the wet side or front wall 56 of casing 38 and a hose 354 connect pump 344 to plenum 52.

Fluid containment and evacuation system 340 may be operated by a control system of the character discussed above and illustrated in FIG. 14. The operation of systems of 20 and 340 is essentially the same except that, in the latter, pump 344 evacuates collected fluid directly from the fluid containment boom rather than from the reservoir of a separate and independent vacuum unit. Pump 344 operates only when the fluid removing capacity of vacuum pump 342 is exceeded and fluid accumulates in casing 38. Because space is more limited in boom casing 38 than in the casing 30 of an independent vacuum unit such as that shown in FIG. 1, it may prove advantageous to replace the float 100 shown in FIG. 14 with a more compact, fluid level sensitive device, albeit this may be more expensive. A variety of appropriate sensors, typically employing electrical characteristic sensing, are commercially available and may be employed.

Figure 15:
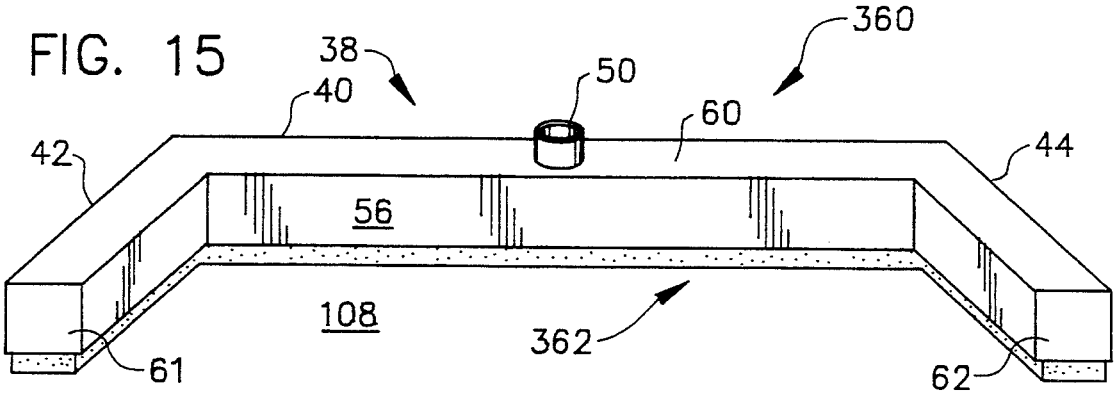
FIG. 15 is a pictorial view of yet another fluid containment boom employing the principles of the present invention.
Figure 16:
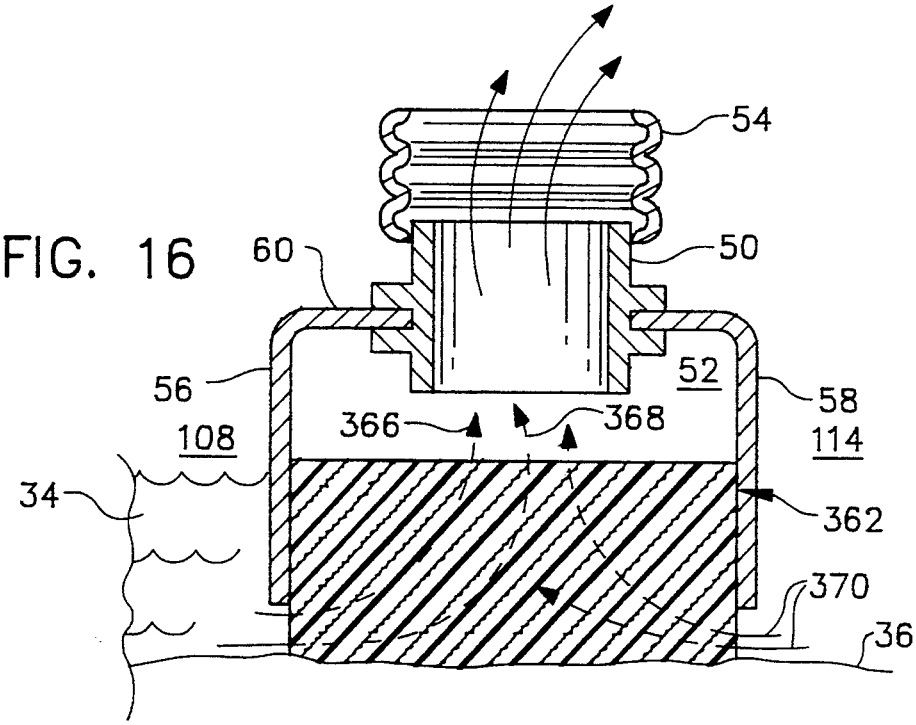
FIG. 16 is a transverse cross-section through the boom of FIG. 16.

Yet another boom for fluid containment and fluid containment and evacuating systems employing the principles of the present invention is illustrated in FIGS. 15 and 16 and identified by reference character 360. This boom differs from those discussed previously in that it has a gasket 362 which extends completely across casing 38 from the front, wet side wall 56 of boom casing 38 to the dry side, rear wall 58. The gasket is dimensioned to provide an airtight seal between it and the casing walls at the bottom, open side 48 of the casing.

In this embodiment of the invention, fluid 34 is drawn from surface 36 through gasket 362 into the boom's vacuum chamber 52 along paths exemplified by arrows 366 and 368. Air concomitantly drawn into the vacuum chamber along paths such as that identified by reference character 370 keeps that fluid from seeping through gasket 362 to the dry side 114 of the boom.

Figure 17:
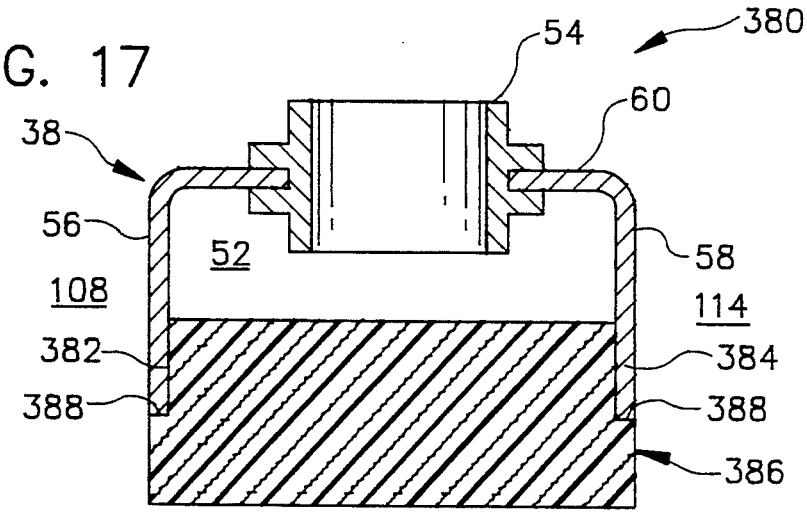
FIG. 17 is a section through a boom which differs from the one shown in FIG. 16 in the configuration of its compressible, seal forming gasket.

FIG. 17 depicts a boom 380 which essentially duplicates boom 360 except that notches such as those identified by reference characters 382 and 384 are formed in the sides and ends of the boom's gasket 386. These notches facilitate the assembly of the gasket and boom casing 38. The walls of boom casing 38 sit on the ledges (such as 388) provided by the notches when the gasket and casing are assembled. This facilitates the assembly of gasket 386 in the correct relationship to casing 38.

Figure 18:
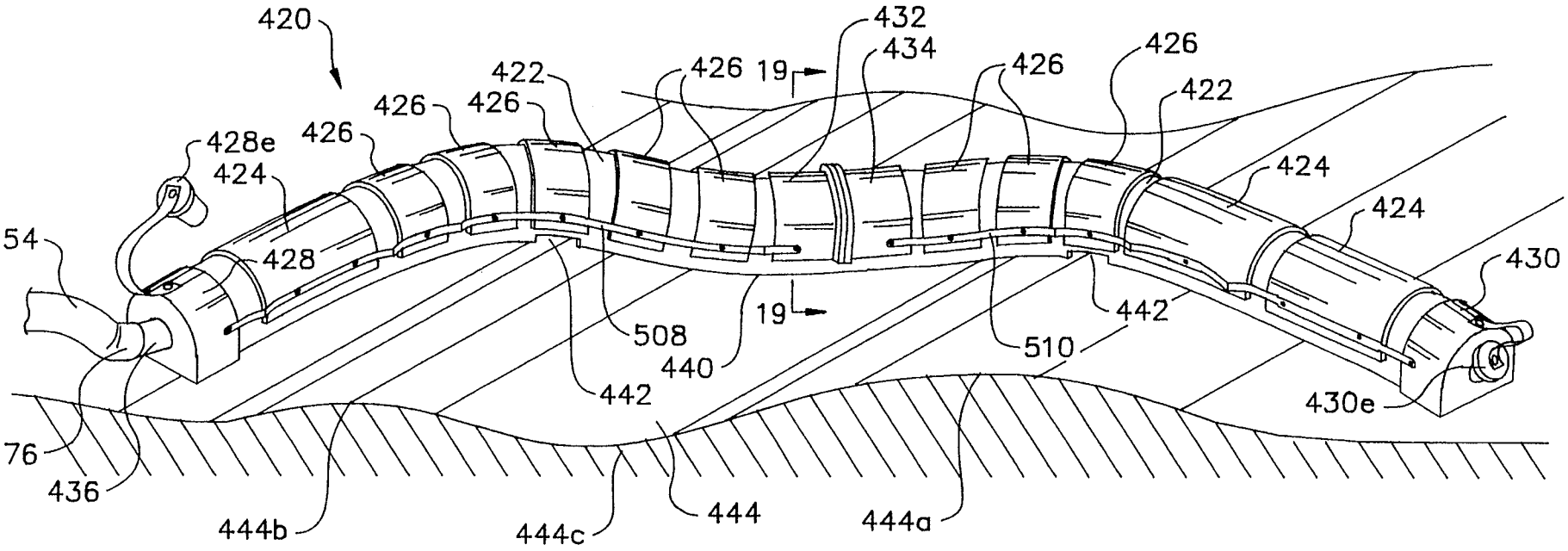
FIG. 18 is a generally pictorial view of a boom which employs the principles of the present invention and may be used in the system shown in FIG. 1.

Referring again to the drawing, depicted at 420 in FIG. 18 and is yet another boom assembly that may be used with the fluid containment and evacuation system 20. This boom assembly 420 includes an elongated, sidewall structure 422, a plurality of ribs 424 and 426, first and second end caps 428 and 430, and a pair of flanged ribs 432 and 434. The boom assembly 420 is connected to the opposite end 76 of the vacuum hose 54 by a fitting 436. That fitting 436 provides fluid communication between an internal vacuum plenum 438 generally defined by the sidewall structure 422 and the vacuum hose 54.

The illustrated, exemplary sidewall structure 422, which is shown in detail in FIGS. 18–23, has an arcuate cross-sectional configuration and is fabricated from a resiliently compressible closed cell polymer. The ribs 424,426, 432, 434, end caps 432 and 434 38, on the other hand, may be fabricated from any appropriate, structurally stable, metallic or non-metallic material.

One exemplary material from which sidewall structure 422 can be fabricated is FLO-10 polymer foam rubber (NBR/PVC). This material is supplied by Halstead and has the following properties:

| | |
|---|---|
| Density, Lbs./Cu. Ft. | 2.5–4.5 |
| Comp. Deflection 25%, psi | 1.5–3.5 |
| Comp. Set 50%, % | 30.0 max. |
| Tensile, psi | 25.0 min. |
| Elongation, % | 75.0 min. |
| Water Absorption, lbs/sq. ft. | 0.1 max. |
| Water Absorption, % | 10.0 max. |
| Heat Aging, % | ±30 |
| Thermal Stability, % | 10.0 max. |
| Ozone Resistance | pass |
| Fluid immersion, wt. % | 100 max. |
| Temperature Use | |
| Limit: Lower, °F. | −40° F. |
| Upper: Upper, °F. | 220° F. |
| Flammability rating | MVSS302 |
| Max width, in | 60 |
| Max. Thickness | 1¼ |
| Roll | Yes |
| Sheet | Yes |
| Tubes | No |
| Colors | Natural |
| Specifications | U.S. Coast Guard UL 1191 |

Spaced at intervals along a bottom, ground engaging edge 440 of the sidewall structure 422 are a series of notches 442. These notches 442 provide paths through which liquid trapped by the boom assembly 420 can be drawn from a surface 444 into the internal chamber or plenum 438 defined by an inner wall 446 of the sidewall structure 422 and the inner, end walls 448 (FIG. 20) and 450 (FIG. 22) of the end caps 428 and 430. Normally, these notches 442 are formed on only one side (the wet side) of the sidewall structure 422.

Notches 442 are provided in this embodiment rather than employing open cell foam to allow liquid to enter the vacuum plenum 438 because, when solids such as sand are present in the liquid, these solids can block the pores in the open cell foam. On the other hand, such solids easily pass through the notches 442 and may be withdrawn from the plenum 438 through the vacuum hose 54. In certain circumstances, it may be necessary to provide a rigidifying structure around the notches 442 to prevent them from being closed by the distortion of the sidewall structure 422 when the negative pressure is formed within the plenum 438.

The above-described unique, segmented arrangement of ribs and end caps joined to a flexible sidewall structure allows the boom assembly 420 to flex to conform to a severely undulating surface such as the surface 444 depicted in FIG. 18. As shown in that figure, the surface 444 comprises closely adjacent high points 444*a* and 444*b* with a low point 444*c* therebetween.

When a vacuum is created in the vacuum plenum 438, the boom assembly 442 continuously conforms to the surface 444 at these points 444*a–b* because the overall shape of the boom assembly is generally determined by the flexible sidewall structure 422 and not the relatively rigid ribs 424, 426, 432, and 434. The sidewall structure 422 is also compressible, allowing a sufficient seal to be formed at its ground engaging edges 440 and 452 (FIGS. 19–22) to maintain the vacuum which keeps the boom assembly in close proximity to the surface 444. However, enough air flows into the plenum 438 between the surface 444 and the boom assembly 442 to ensure a steady flow of air which atomizes the liquid within the plenum 438 as it is drawn into the vacuum hose.

These ribs 424, 426, 432, and 434, on the other hand, are so spaced along the sidewall structure 422 that the sidewall structure maintains its arcuate cross-sectional, and thus plenum defining, configuration along its entire length. The boom assembly 422 may thus be successfully employed in the fluid containment and evacuation system 20 while still allowing the system 20 to contain and evacuate liquid from a severely undulating surface. One exemplary material from which ribs 424, 426, 432, and 434 can be fabricated is ABS plastic. This material is supplied by Sparreck Plastics or Royalire Plastics.

While the exemplary boom 420 described herein employs ribs separate from the sidewall to provide structural rigidity and weight to the boom, other means may be selected for providing this structural rigidity. For example, in some circumstances, the structure of the sidewall itself may be modified so that a portion of the sidewall is rigid to maintain the required shape, but the bottom ends of the sidewall can be left unmodified so that they provide the required sealing action between the boom and the surface on which it is placed. Such modification may include applying heat and pressure to the closed cell foam, impregnating the closed cell foam with a rigidifying substance, or modifying the external shape of the closed cell foam so that it is more sound structurally. One example of such a modified shape will be discussed below with reference to FIGS. 25 and 26.

Referring back to FIG. 18, it can be seen that the ribs 424 and 426 may be of different lengths, where length is defined as that dimension of the ribs in the direction of the longitudinal axis of the boom 420. Specifically, the exemplary ribs 424 are longer than the ribs 426. These longer ribs 424 may be used when the boom will be used with less undulating surfaces and near the ends, as shown, to limit the curvature of the boom near these ends to facilitate remove of fluid from therewithin.

Referring again to FIGS. 20 and 22, the details of the end caps 428 and 430 will be described in more detail. As shown therein, each of these end caps comprises an end wall 428*a*, 430*a* and an inner retaining ring 428*b*, 430*b*. Inwardly and downwardly extending cylindrical portions 428*c*, 430*c* of these walls 428*a*, 430*a* define passageways 428*d*, 430*d*. The fitting 436 may be so inserted into these passageways that an opening 436*a* of the fitting is angled with respect to the longitudinal axis A of the boom 420. The angling of the passageways 428*d*, 430*d*, and thus the fitting 436, prevents liquid from blocking the fitting opening 436*a*; instead, air passing through the opening 436*a* atomizes the liquid where it partially blocks the opening 436*a*. The atomized liquid is thus easily withdrawn through the vacuum hose 54 and accumulates in the reservoir 32. Plugs 428*e*, 430*e* are associated with each of the end caps 428 and 430 to close the passageways 428*d* or 430*d* (in this case the passageway 430*d*) which is not in use.

Figure 19:
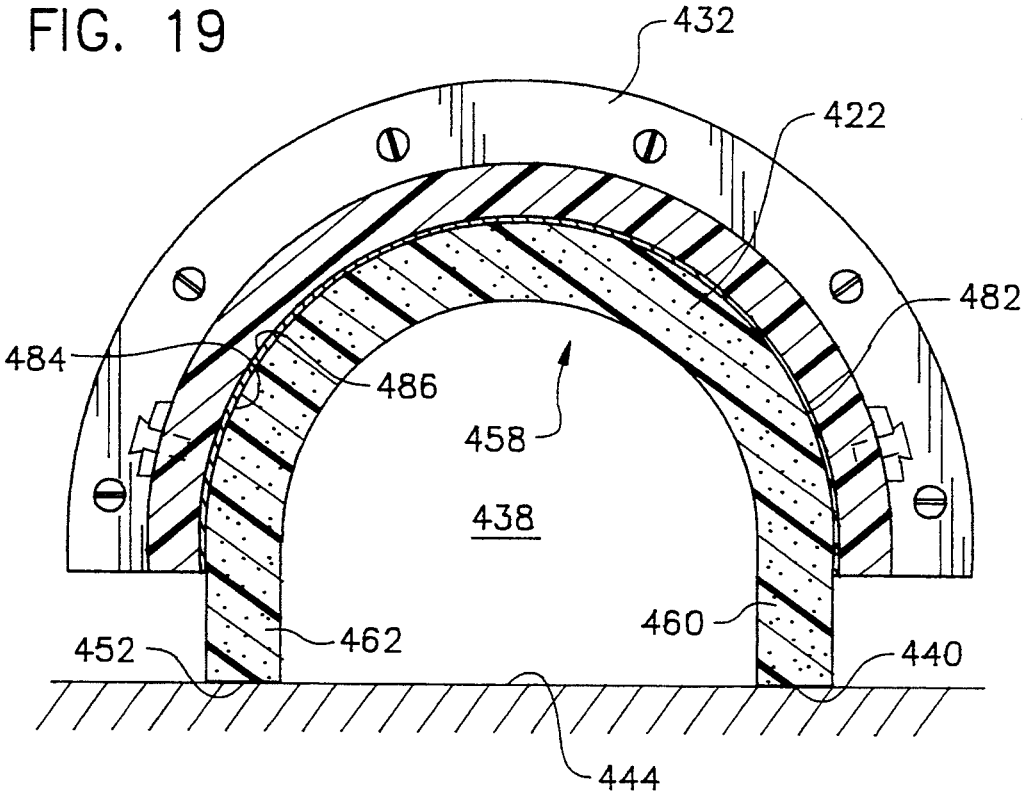
FIG. 19 is a transverse cross-section through the boom of FIG. 18 at lines 19—19 showing one method of attaching ribs to the sidewall.
Figure 20:
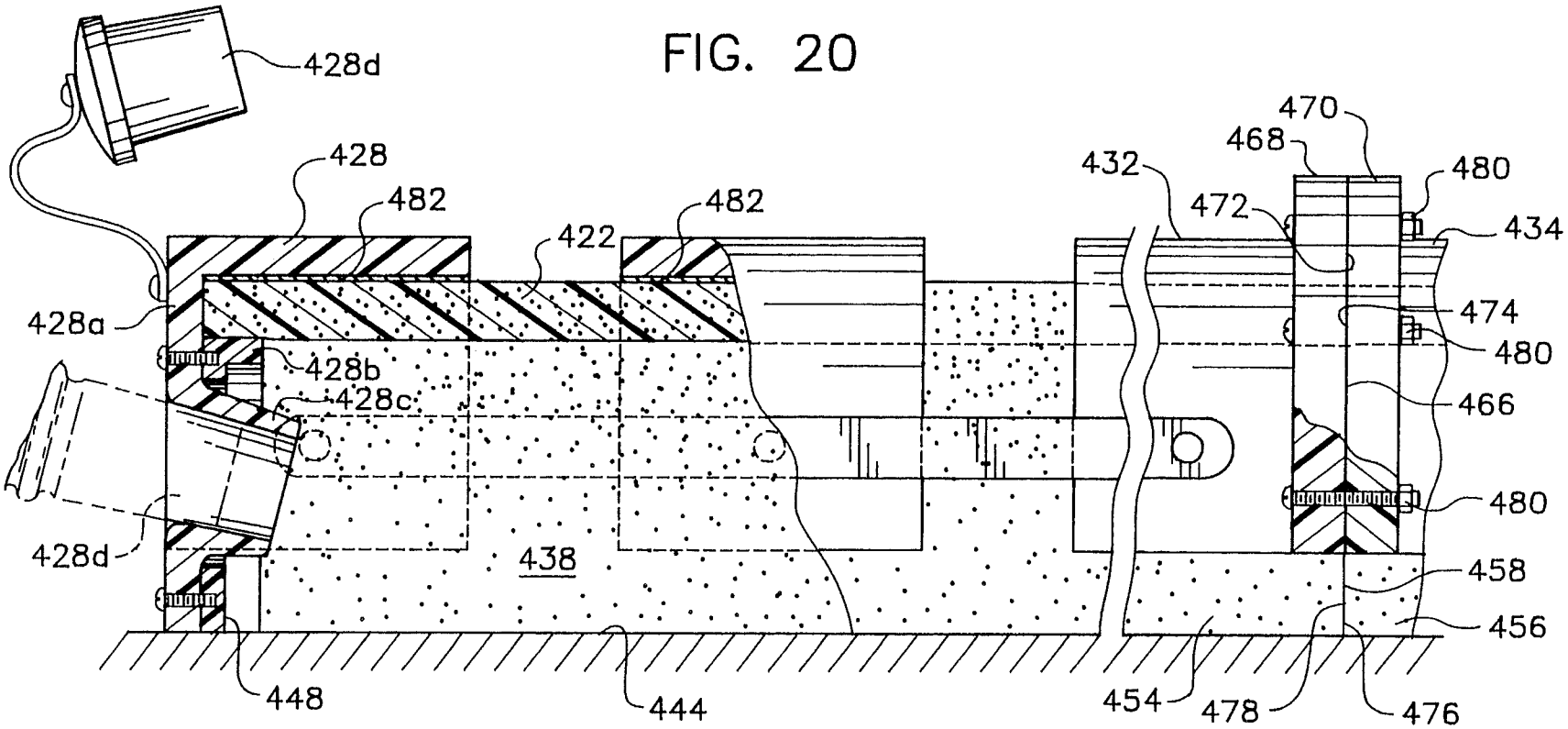
FIG. 20 is a side, plan, partial fragmentary view of a portion of the boom depicted in FIG. 18.

Referring for a moment to FIG. 20, it can be seen that the sidewall structure 422 actually comprises a first section 454 and a second section 456 joined along a seam 458. These portions are monolithic and, as shown in FIG. 19, each comprise a generally semi-circular upper portion 460 and front and back (or wet and dry) walls 462 and 464 extending downwardly from the upper portion 460. The front and back walls 462 and 464 terminate in the lower, ground engaging edges 440 and 452, respectively.

The juncture of these sidewall section 454 and 456 at the seam 458 is generally coplanar with the juncture formed by a seam 466 between flanges 468 and 470 of the flange ribs 432 and 434. The flange ribs 432 and 434 thus allow any number of sidewall sections 454 and 456 to be joined together into a boom assembly of arbitrary length. For example, one or more sections having flange ribs mounted on each end can be inserted into the boom assembly 420 by separating the flange ribs 432 and 434 and inserting the additional sections therebetween.

To enhance the ability of the boom 420 to maintain the vacuum therewithin, sealing means may be formed along the seam 458. An expeditious means of forming this sealing means is to so attach at least one of the flange ribs 432 to the sidewall sections 454 and 456 that the opposing faces 472 and 474 are set back slightly from the opposing faces 476 and 478 of the sidewall sections 454 and 456. Thus, when means such as screw/-bolt combinations 480 depicted in FIG. 20 are employed to join the flange ribs 432 and 434 together, the protruding sidewall section faces 476 and 478 meet and compress the sidewall sections near the seam 458 in a manner that prevents a gap from forming at, and thus seals, this seam 458.

Referring back to FIGS. 19–21 for a moment, means for attaching the ribs 424, 426, 432, and 434 to the sidewall structure 422 will now be discussed. As will become apparent from the following discussion, the same means may be used interchangeably, with slight variations as noted below, to join the various ribs 424, 426, 432, and 434 to the sidewall structure 422.

FIG. 19 depicts a layer of chemical adhesive 482 that may be used to join a rib, in this case the flange rib 432, to the sidewall 422. This chemical adhesive 482 is normally applied to the inner side 484 of the rib and/or the outer surface 486 of the sidewall and may be any adhesive appropriate to form a bond between the sidewall and the rib given the properties of the materials chosen for the sidewall and rib. The properties of the fluid to be removed by the boom 420 should also be considered when choosing this chemical adhesive 482. FIG. 20 shows a layer of the chemical adhesive 482 being employed to attach the end cap 428 to the sidewall 422.

Figure 21:
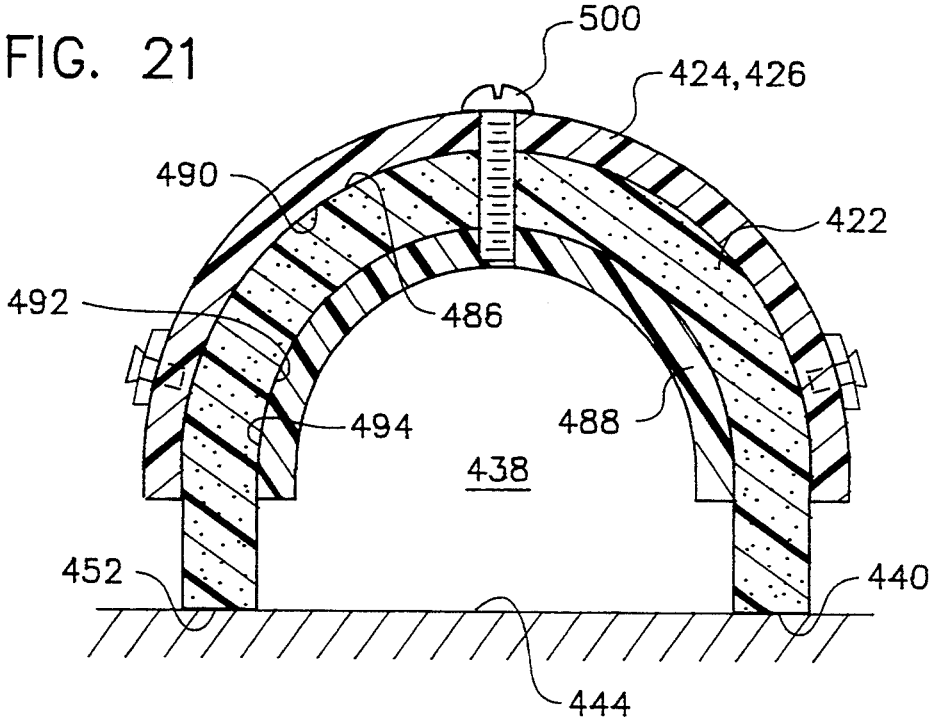
FIG. 21 is a transverse cross-section showing a second method of attaching ribs to the sidewall.

FIG. 21 depicts an alternative structure that may be employed to attach a rib, in this case one of the ribs 424 or 426, to the sidewall 422. In this structure, an inner rib 488 is provided on the inner side 484 of the sidewall 422. The sidewall 422 is so clamped between the outer rib 424 or 426 and the inner rib 488 that: the sidewall outer surface 486 contacts the outer rib inner surface 490 and a sidewall inner surface 492 contacts an outer wall 494 of the inner rib 488. This exemplary inner rib 484 generally matches the dimensions of the outer rib 424 or 426 but has a smaller radius of curvature so that it conforms to the sidewall inner surface 492.

Figure 22:
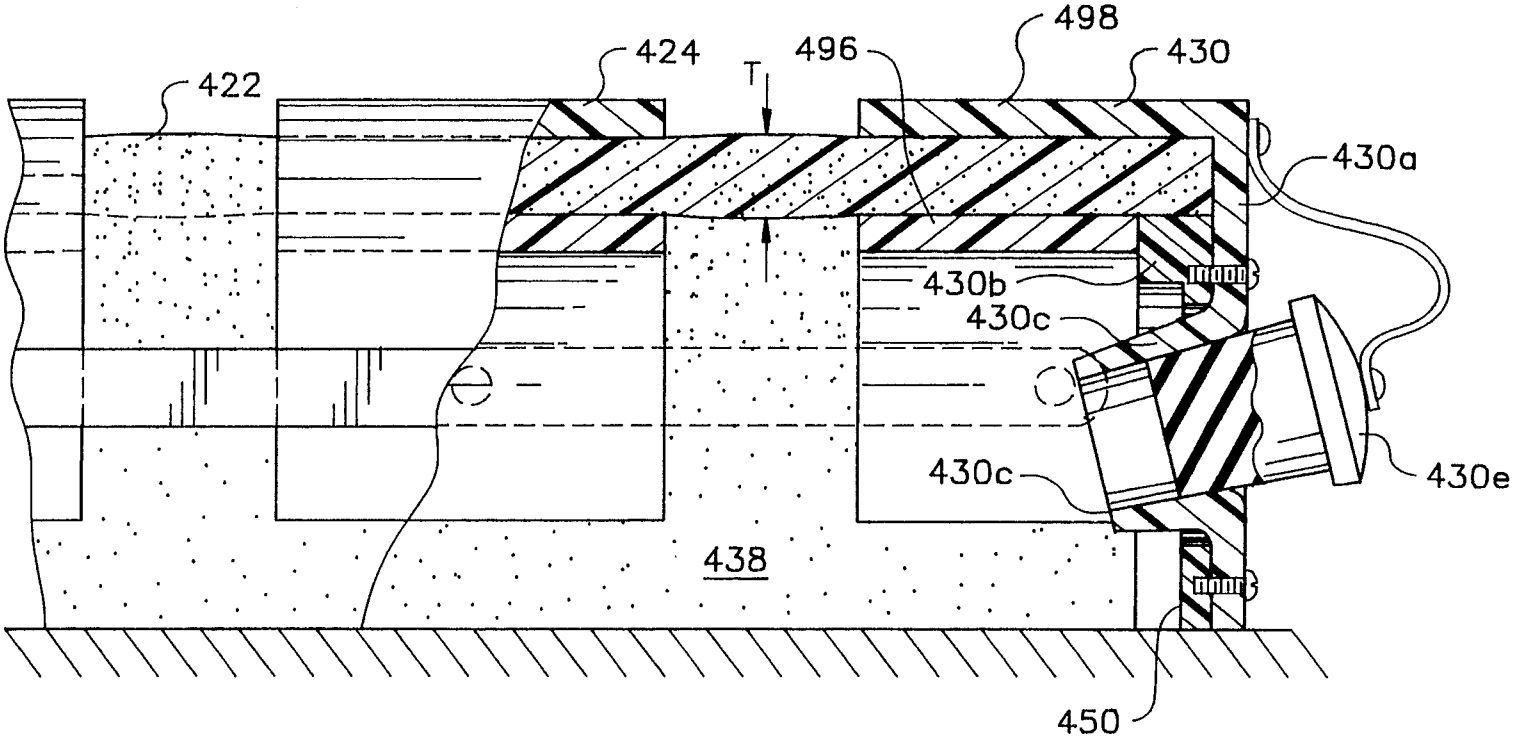
FIG. 22 is a side, plan, partial fragmentary view of a portion of the boom depicted in FIG. 18.
Figure 23:
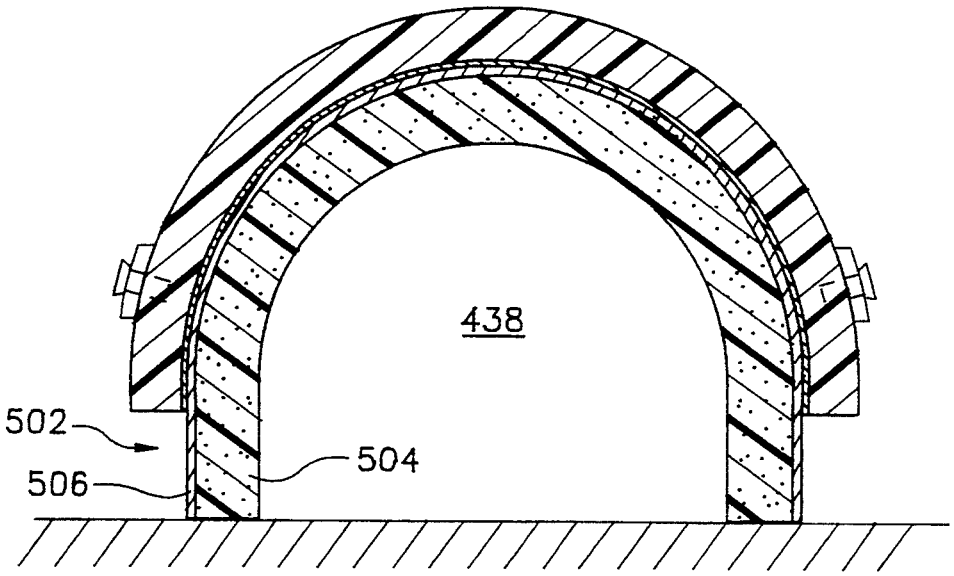
FIG. 23 is a transverse cross-section showing a layer of material for preventing overstretching of the sidewall.

The clamping action exerted by the outer and inner ribs is depicted in FIG. 22 by the slightly expanded thickness T of the sidewall 422 between the rib 424 and the end cap 430. It can also be seen from FIG. 22 that the clamping apparatus shown in FIG. 21 may be employed to attach the end caps 428 and 430 to the sidewall 422. The end cap 430 is depicted with an inner cap liner 496. The sidewall 422 is clamped between an arcuate portion 498 of the end cap 430 and this cap liner 496.

When an inner rib or liner is employed to attach the ribs or end caps to the sidewall, screws and cooperating threaded holes are provided as shown at 500 in FIG. 21 are employed to draw these components together to obtain the above-described clamping action.

The clamping structure just described is stronger and less susceptible to the debilitating effects of corrosive fluids within the boom than the chemical adhesive described above; however, the chemical adhesive is less expensive to implement and may be sufficient in many cases.

The sidewall 422 itself may be implemented in several different configurations. For example, a sidewall structure such as that indicated at 502 in FIG. 23 may be appropriate for certain circumstances. This structure 502 comprises an inner portion 504 corresponding to the sidewall structure 422 and an outer limiting lining or coating 506 of material that stretches less than the amount that the inner portion 504 stretches before tearing. The outer lining 506 thus limits the amount that the sidewall structure 502 stretches to prevent tearing of the inner portion 504. An appropriate lining or coating for an inner portion 504 corresponding to the sidewall 422 is stretch Lycra, which is commonly available at fabric stores.

Referring now to FIG. 18, it can be seen that the boom 420 is further optionally provided with limiting straps 524 and 526 connecting the various ribs 426, 428, 432, and 434 and end caps 428 and 430. These straps 524 and 526 are flexible but not stretchable; accordingly, the straps 524 and 526 connect adjacent ribs or end caps to prevent tearing of the sidewall 422 when the ribs and end caps are separated during the process of laying the boom 420 in a desired orientation on the surface 444. These straps thus serve a function similar to that of the outer lining 506 just-described.

Figure 24:
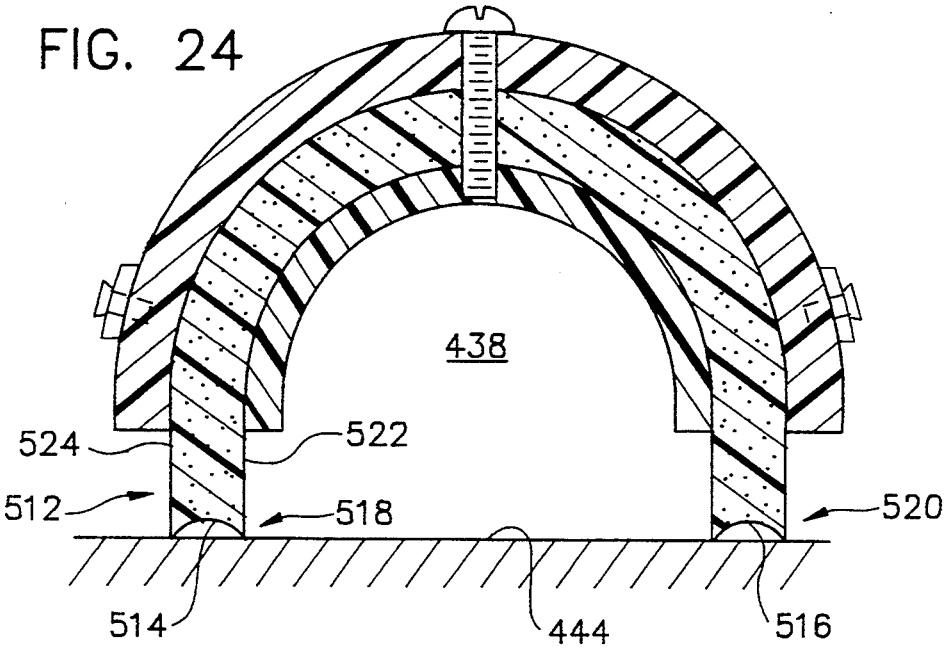
FIG. 24 is a transverse cross-section showing a concave lower surface along the edge of the sidewall for enhancing the ability of the sidewall to conform to the surface on which the boom sits.
Figure 24A:
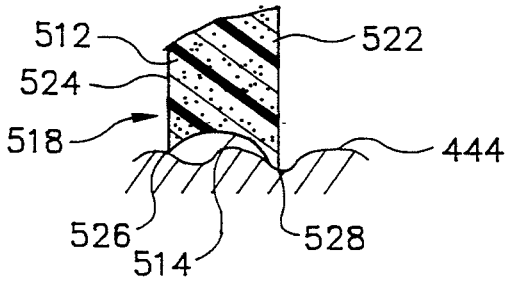
FIG. 24A is fragment of the sidewall shown in FIG. 24 drawn to an enlarged scale to detail the construction of the sidewall.

Yet another sidewall configuration is depicted at 512 in FIGS. 24 and 24A. The sidewall 512 corresponds in overall physical configuration to the sidewall 422 described above but has concave or hourglass surfaces 514 and 516 formed on its lower, ground engaging ends 518 and 520. As shown in detail in FIG. 24A, these concave surfaces 514 and 516 and sidewall inner and outer surfaces 522 and 524 meet at edges such as edges 526 and 528.

The thickness of the sidewall 512 is reduced near these edges 526 and 528, allowing more compression of the sidewall 512 at the ends 518 and 520 to form a better seal between these sidewall ends and the surface 444 on which the boom 420 resides. Specifically, the reduced sidewall thickness near these edges 526 and 528 allow foam easily to compress into textured surfaces. This is because these edges exhibit less spring tension which would otherwise be resistant to ready conformity with the surface and thus require a higher vacuum pressure to compress the foam and obtain a sealing effect This extra compression and thus sealing is desirable when the surface 444 is severely undulating on a small scale as shown in FIG. 24A as well as on a large scale as shown in FIG. 18.

Still another sidewall configuration is depicted at 530 in FIG. 25. This sidewall 530 is constructed from generally the same materials as the sidewall 422 but has accordion-like ridges 532 and valleys 534 extending along its outer surface 536 and transverse to its longitudinal axis A. These ridges 532 and valleys 534 have corresponding valleys and ridges, respectively, on the sidewall inner surface (not shown). These ridges 532 and corresponding valleys 536: (a) provide rigidity to the sidewall 530; and (b) accommodate bending of the sidewall 530 by, for example, allowing expansion on the front side and contraction along the back side of the sidewall.

As indicated at 538 in FIG. 26, an accordion-like sidewall such as the sidewall 530 may, in some circumstances, provide sufficient rigidity that it may be used without structural ribs.

Figure 27:
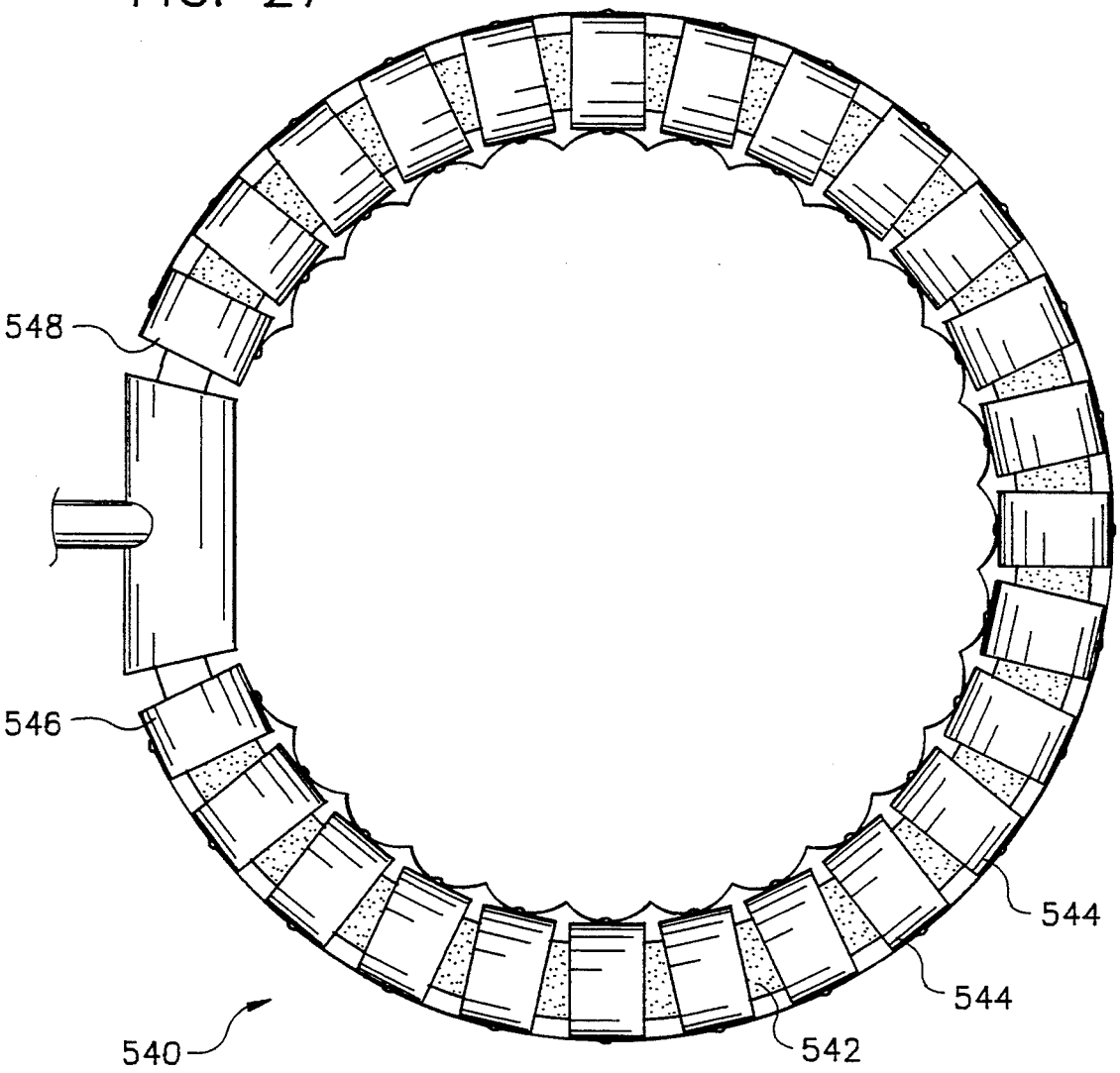
FIG. 27 is a top, plan view of a still another boom that may be used in the system shown in FIG. 1.
Figure 28:
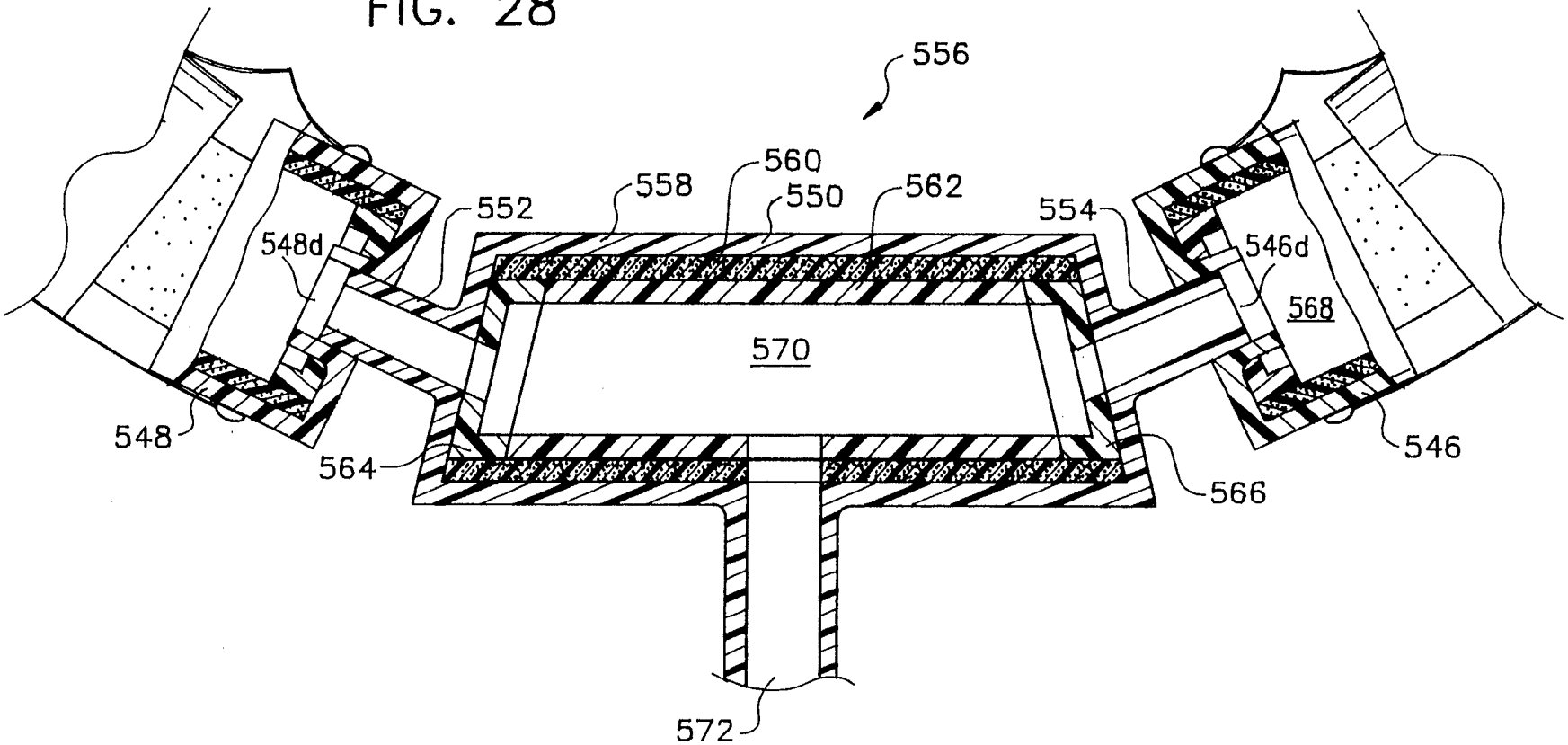
FIG. 28 is a top, plan, partial cut-away view of a portion of the boom shown in FIG. 26.

Depicted in FIGS. 27 and 28 is another exemplary boom constructed in accordance with the present invention. This boom 540 comprises a single section of sidewall 542 similar to the sidewall sections 454 and 456 described above. Ribs 544 similar to the ribs 426 described above are spaced at intervals along the length of the sidewall 542, and end caps 546 and 548 such as the end caps 428 and 430 are placed on the ends of the sidewall 542.

However, instead of inserting the vacuum hose 54 directly into one of the end caps 546 or 548, the hose 54 is inserted in a T-fitting 550. This T-fitting 550 has first and second hollow cylindrical projections 552 and 554 which extend from a body 556. The body 556 comprises an outer casing 558, a sidewall 560, and (in this example) an inner liner 562. Retaining liners 564 and 566 are arranged within and at the ends of the body 556.

The first and second projections 552 and 554 extend into the end cap passageways **546*d* and 548*d* to allow communication between the vacuum plenum 568 within the boom 540 and a cavity 570 defined by the T-fitting body 556 and the surface on which the boom 540 is placed. A vacuum port 572 allows communication between the vacuum hose 54 and the cavity 570. Accordingly, liquid is removed from both ends of the boom 540 when the pump unit 24** is operated.

This boom 540 may be placed in a circular configuration as shown in FIG. 27. This configuration is optimal for situations in which liquid is flowing in all directions from a single point. The boom 540 is simply arranged so that the point from which the liquid is flowing is within the circle defined by the boom.

Figure 29:
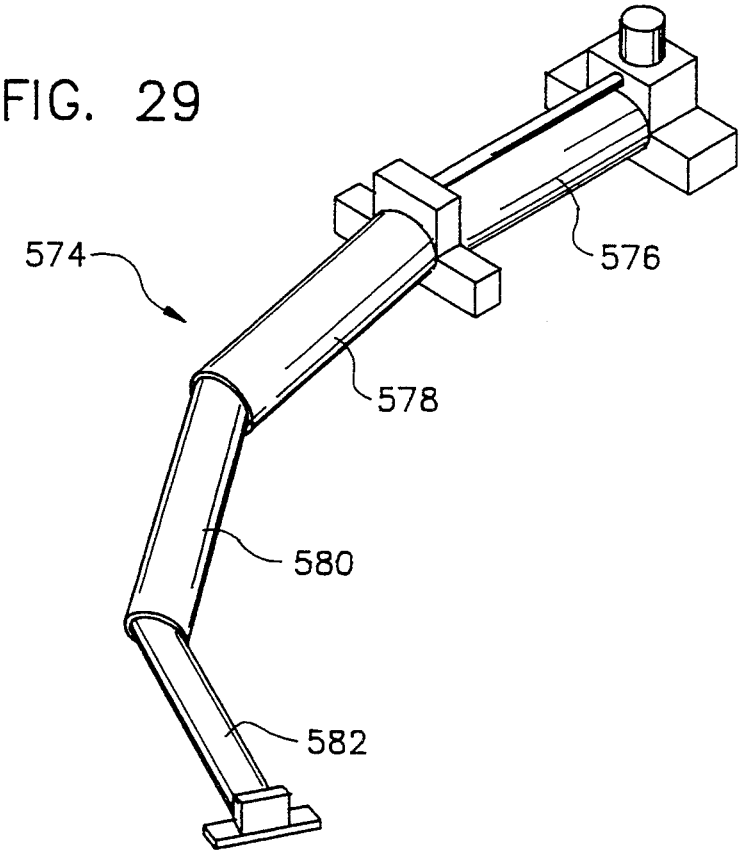
FIG. 29 is a generally pictorial view of a telescoping boom which employs the principles of the present invention and may be used in the system shown in FIG. 1.
Figure 30:
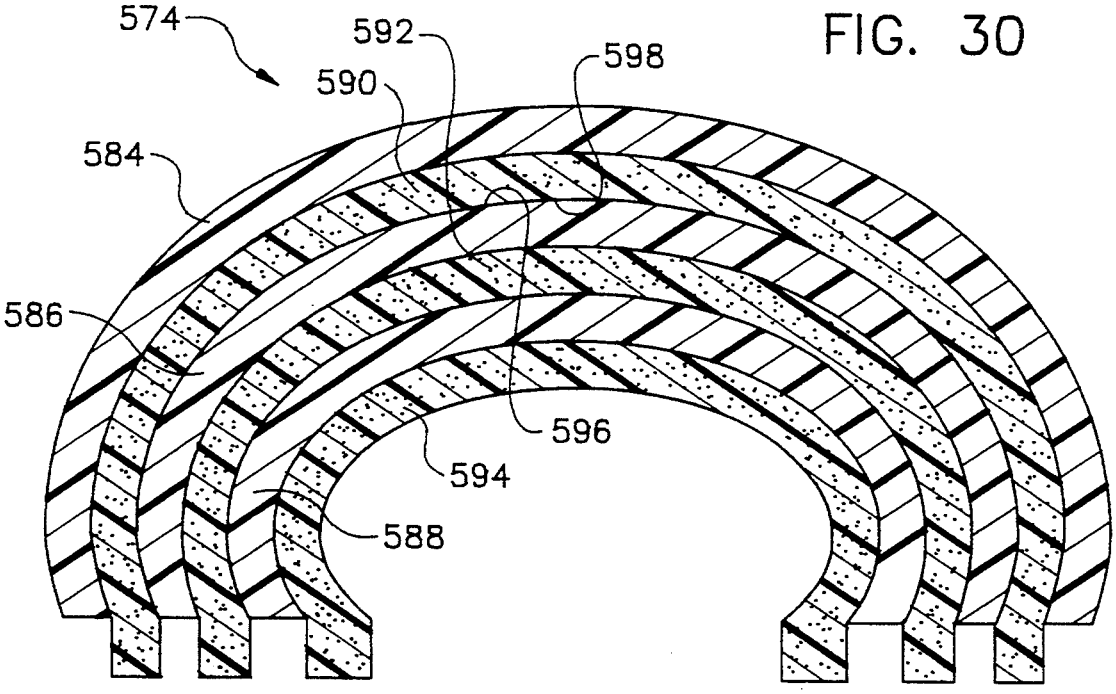
FIG. 30 is a transverse cross-sectional view showing generally oval configuration of the sections of the boom depicted in FIG. 29.

Yet another exemplary boom of the present invention is depicted at 574 in FIGS. 29 and 30. This boom 574 telescopes to allow its length, or span, to be tailored to fit a specific application or environment.

The boom 574 comprises first through fourth segments 576, 578, 580, and 582 arranged in that order. Starting with the first segment 578, the dimensions of these segments decrease to allow each succeeding segment to fit within its preceding segment in a telescoping manner. This is clearly shown in FIG. 30, which depicts the segments 578, 580, and 582 folded together into a short length or span.

More particularly, as shown in FIG. 30, each of these segments 578–582 comprises a casing portion 584, 586, and 588 and a sidewall portion 590, 592, and 594. During operation of the system 20, these casings and sidewalls function in the same general manner as the sidewall 422 and ribs 424 and 426, so this operation will not be described in detail herein.

An outer surface 596 of the second segment casing 586 conforms to an inner surface 598 of the first segment sidewall portion 590. The second segment sidewall 592 and the third segment casing 588 are similarly related. This arrangement allows segments to fit snugly within their preceding adjacent segment when the boom 576 is folded.

Another feature of this boom 576 is that the segments are generally oval in cross-sectional shape. This generally oval shape, with one side of the oval shape partially removed to form an open bottom, allows smaller segments to be retained within the open sides of larger segments without falling out.

The invention disclosed and claimed herein may be embodied in specific forms other than those described above without departing from the spirit or essential characteristics thereof. For example, in certain circumstances, notches such as the notches 442 may be spaced at intervals along the ground engaging edges of both sides of the sidewall structure. This might be the case when a standing body of spilled liquid needs to be recovered. A containment boom having notches formed along both ground engaging edges would be placed in the center of the standing body of liquid, and the liquid could be squeegeed towards the boom and into the notches where it can be vacuumed from the boom plenum.

The present embodiments are therefore to be considered in all respects as illustrative and not restrictive. The scope of the invention is indicated by the appended claims rather than the foregoing description. All changes which come within the meaning and range of equivalency of the claims are intended to be embraced therein.

What is claimed is:

1. A fluid containment and removal system for disposing of a fluid on a surface, said system comprising:

a. fluid containment means for trapping the fluid on said surface, the fluid containment means comprising;

i. an elongated, open bottom, vacuum plenum defining member with spaced apart front and back walls and outlet means, vacuum plenum defining member being arranged on said surface such that at least part of the vacuum plenum is directly exposed to said surface, ii. means for providing structural rigidity to the plenum defining member to maintain the member in its vacuum plenum defining shape, and iii. means for allowing ingress of fluid from the exterior of the fluid containment means to the vacuum plenum thereof; and b. means for evacuating from the surface fluid trapped by the fluid containment means, the fluid evacuating means comprising a vacuum pump and a vacuum line so providing fluid communication between the vacuum pump and the outlet means of the fluid containment means as to enable the pump to create a negative pressure in the vacuum plenum of the fluid containment means and thereby:

i. create on the fluid containment means a pressure effective to adhere the fluid containment means to the surface in a manner that allows negative pressure to be maintained within the plenum, and ii. evacuate fluid from the surface through the ingress allowing means into the vacuum plenum and discharge fluid from the vacuum plenum through the vacuum line.

2. A fluid containment and removal system as defined in claim 1 wherein the fluid evacuating means includes means mounting the vacuum pump on the fluid containment means.

3. A fluid containment and removal system as defined in claim 1 in which said fluid evacuating means also has a reservoir for fluid discharged from the vacuum plenum in the fluid containment means through the vacuum line and means for preventing the level of the fluid in the reservoir from exceeding a selected maximum.

4. A fluid containment and removal system as recited in claim 3, in which the means for preventing the level from exceeding a selected maximum comprises a second pump communicating on its inlet side with the fluid reservoir and a fluid level responsive means for turning the second pump on when the fluid in the reservoir reaches a predetermined level.

5. A fluid containment and removal system as recited in claim 1, in which the plenum defining member comprises at least one monolithic sheet of compressible material.

6. A fluid containment and removal system as recited in claim 5, in which the means for providing structural rigidity comprises a plurality of first ribs and means for attaching the first ribs to the at least one sheet of compressible material at intervals along a longitudinal axis of the fluid containment means.

7. A fluid containment and removal system as recited in claim 6, in which the plenum defining member further comprises first and second end caps defining first and second end walls thereof, the outlet means being formed in at least one of these end caps.

8. A fluid containment and removal system as recited in claim 7, in which the outlet means comprises a pipe having an opening within said vacuum plenum, the pipe opening being so arranged that it is angled with respect to the longitudinal axis of the plenum defining member.

9. A fluid containment and removal system as recited in claim 8, in which the pipe extends through an end wall of the end cap.

10. A fluid containment and removal system as recited in claim 6, in which the plenum defining member comprises a plurality of monolithic sheets of compressible material arranged end to end, further comprising means for so connecting abutting ends of the monolithic sheets together that an appropriate vacuum may be maintained in the vacuum plenum.

11. A fluid containment and removal system as recited in claim 10, in which the means for connecting the abutting ends of the monolithic sheets together comprises flanged ribs attached adjacent to each of the abutting ends and means for connecting the flanged ribs together.

12. A fluid containment and removal system as recited in claim 11, in which the flanged ribs are set back slightly from the abutting edges that the sheets compress at the ends to form a seal at the juncture of the abutting edges when the ribs are connected together.

13. A fluid containment and removal system as recited in claim 6, in which the attaching means comprises an adhesive for bonding the first ribs to an external surface of the fluid containment means.

14. A fluid containment and removal system as recited in claim 6, in which the attaching means comprises a second rib corresponding to each first rib and means for clamping the plenum defining member between the first and second ribs.

15. A fluid containment and removal system as recited in claim 6, further comprising means for limiting the movement of one rib relative to each of it adjacent ribs to inhibit structural damage to the plenum defining member caused by tension loads placed on the fluid containment means.

16. A fluid containment and removal system as recited in claim 5, in which the monolithic sheet is formed with an accordion-like hill and valley structure.

17. A fluid containment and removal system as recited in claim 1, in which the means for providing structural rigidity are integrally formed with the plenum defining means.

18. A fluid containment and removal system as recited in claim 1, further comprising means for inhibiting structural damage to the plenum defining member caused by tension loads placed on the fluid containment means.

19. A fluid containment and removal system as recited in claim 18, in which the means for inhibiting structural damage to the plenum defining member comprises a layer of limiting material having at least one axis of stretch, where the limiting material is bonded to the plenum defining member with its axis of stretch so arranged that the limiting material does not stretch beyond that amount of stretch at which damage to the plenum defining member might occur under tension loads.

20. A fluid containment and removal system as recited in claim 1, in which at least one edge of the fluid containment means which engages the surface comprises an inwardly curved face opposing the surface, where the inwardly curved face defines two compressible projections of reduced surface area which deform to allow the negative pressure to be formed within the vacuum plenum.

21. A fluid containment And removal system as recited in claim 1, in which the fluid containment means further comprises a fitting, where the outlet means is formed in the fitting, the fitting cooperates with the surface to define a chamber, and the chamber so connected to first and second ends of the fluid containment means that: (a) the fluid containment means takes on a generally circular configuration; and (b) liquid within the vacuum plenum is discharged first into the chamber and then through the vacuum line.

22. A fluid containment and removal system as recited in claim 1, in which the plenum defining member comprises a plurality of segments one so arranged within another that the length of the fluid containment means may be changed by moving the segments relative to each other in a telescoping manner.

23. A fluid containment and removal system as recited in claim 22, in which the segments are generally oval in cross-sectional and have an opening opposing the surface, where the oval cross-section prevents segments from coming out of the segments within which they reside.

24. A fluid containment and removal system as recited in claim 1, in which the means for allowing ingress of fluid comprises notches so formed at intervals in at least one of the walls of the plenum defining member adjacent the surface that the notches allow fluid reaching the fluid containment means to be sucked through the member into the vacuum plenum for removal from the surface without destroying the negative pressure within the vacuum plenum.

25. A fluid containment and removal system as recited in claim 24, in which the plenum defining member is formed from closed cell foam.

26. A fluid containment and removal system as recited in claim 1, in which the means for allowing ingress of fluid comprises a sufficiently high proportion of communicating open cells formed in the plenum defining member that fluid reaching the fluid containment means can be sucked through the member into the vacuum plenum for removal from the surface.

27. A fluid containment and removal system as recited in claim 1, in which:

a. at least a portion of the member is composed of compressible material that engages the surface; and b. the negative pressure in the vacuum plenum of the fluid containment means creates on the fluid containment means a pressure effective to deform the compressible portion of the vacuum defining member into conformity with the surface and immobilize the fluid containment means on the surface as aforesaid.

28. A fluid containment means which comprises:

an elongated, vacuum plenum defining member;

the plenum defining member comprising at least a compressible portion at an open, bottom end of the plenum defining member, the compressible portion being so compressible into conformity with a surface on which the fluid containment means is placed when a vacuum is created in the vacuum plenum as to fix the fluid containment means in position on the surface, and providing a barrier against fluid on the surface;

means for creating a vacuum in the vacuum plenum;

the material of which the compressible portion is formed being closed cell foam; and at least one notch being so formed in the compressible portion adjacent the surface that fluid reaching the fluid containment means can be sucked through the at least one notch into the vacuum plenum for removal from the surface.

* * * * *